US010132263B2

(12) United States Patent
Kuroda et al.

(10) Patent No.: US 10,132,263 B2
(45) Date of Patent: Nov. 20, 2018

(54) FUEL INJECTION CONTROL DEVICE AND METHOD FOR ENGINE

(71) Applicant: TOYOTA JIDOSHA KABUSHIKI KAISHA, Toyota-shi (JP)

(72) Inventors: Ryusuke Kuroda, Nisshin (JP); Masanao Idogawa, Toyota (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 0 days.

(21) Appl. No.: 15/642,651

(22) Filed: Jul. 6, 2017

(65) Prior Publication Data

US 2018/0017007 A1 Jan. 18, 2018

(30) Foreign Application Priority Data

Jul. 12, 2016 (JP) ..... 2016-137775

(51) Int. Cl.

| | |
|---|---|
| ***F02D 41/14*** | (2006.01) |
| ***F02D 41/24*** | (2006.01) |
| ***F02M 37/04*** | (2006.01) |
| ***F02D 41/30*** | (2006.01) |
| *F02D 41/18* | (2006.01) |

(52) U.S. Cl.

CPC ..... *F02D 41/2454* (2013.01); *F02D 41/1454* (2013.01); *F02D 41/248* (2013.01); *F02D 41/2445* (2013.01); *F02D 41/2461* (2013.01); *F02D 41/2467* (2013.01); *F02D 41/3094* (2013.01); *F02M 37/04* (2013.01); *F02D 2200/06* (2013.01)

(58) Field of Classification Search

CPC ..... F02D 41/2454; F02D 41/2445; F02D 41/2461; F02D 41/2467; F02D 41/248; F02D 41/1454; F02D 41/3094

USPC ..... 123/445, 674

See application file for complete search history.

(56) References Cited

U.S. PATENT DOCUMENTS

| | | | | |
|---|---|---|---|---|
| 2005/0166896 | A1 | 8/2005 | Sadakane et al. | |
| 2006/0207559 | A1* | 9/2006 | Kinose | F02D 41/2445 123/431 |
| 2007/0074709 | A1 | 4/2007 | Kato et al. | |

(Continued)

FOREIGN PATENT DOCUMENTS

| | | |
|---|---|---|
| JP | 2005-48730 | 2/2005 |
| JP | 2005-201083 | 7/2005 |

(Continued)

*Primary Examiner* — Mahmoud Gimie

(74) *Attorney, Agent, or Firm* — Oblon, McClelland, Maier & Neustadt, L.L.P.

(57) ABSTRACT

A fuel injection control device learns a port injection learning value and a direct injection learning value separately for each of learning regions that are divided according to the engine operating state. It is assumed that a port injection learning condition and a direct injection learning condition are both satisfied in a learning region in which neither the learning of the port injection learning value nor the learning of the direct injection learning value has been completed. In such a situation, the fuel injection control device executes the port injection learning process if the ratio of the port injection amount is less than the ratio of the direct injection amount, and executes the direct injection learning process if the ratio of the direct injection amount is less than the ratio of the port injection amount.

7 Claims, 9 Drawing Sheets

(56) References Cited

U.S. PATENT DOCUMENTS

| | | | | |
|---|---|---|---|---|
| 2012/0116654 | A1 | 5/2012 | Toyohara et al. | |
| 2015/0176511 | A1* | 6/2015 | Ando | F02D 41/025 60/285 |

FOREIGN PATENT DOCUMENTS

| | | |
|---|---|---|
| JP | 2005-307756 | 11/2005 |
| JP | 2006-258037 | 9/2006 |
| JP | 2007-100575 | 4/2007 |
| JP | 2010-133358 | 6/2010 |
| JP | 2010-196558 | 9/2010 |
| JP | 2012-97693 | 5/2012 |

* cited by examiner

FUEL INJECTION CONTROL DEVICE AND METHOD FOR ENGINE

BACKGROUND OF THE INVENTION

The present invention relates to a fuel injection control device and method for an engine having a port injection valve and a direct injection valve.

In an engine, in order to control the air-fuel ratio of air-fuel mixture burned in a cylinder to a target air-fuel ratio, it is only necessary to determine a fuel supply amount such that the ratio of the fuel supply amount to the amount of air introduced into the cylinder (cylinder inflow air amount) becomes the reciprocal of the target air-fuel ratio. However, there are variations in the output characteristics of the air flow meter used to calculate the cylinder inflow air amount and in the injection characteristics of the fuel injection valves. Thus, mere determination of the fuel supply amount based on the cylinder inflow air amount calculated based on the output of the air flow meter will result in deviation of the air-fuel ratio from the target air-fuel ratio.

Such deviation of the air-fuel ratio can be corrected by air-fuel ratio feedback control that corrects the fuel supply amount in accordance with the difference of the air-fuel ratio with respect to the target air-fuel ratio. Further, the responsiveness of the air-fuel ratio feedback control can be improved by obtaining the deviation of the air-fuel ratio from the result of the air-fuel ratio feedback control and learning the deviation as an air-fuel ratio learning value, and reflecting the air-fuel ratio learning value in the air-fuel ratio feedback control. Variations of the air-fuel ratio may show different tendencies depending on the operating state of the engine. Therefore, the learning of the air-fuel ratio learning value is desirably executed separately for each of learning regions divided according to the operation regions of the engine.

Some engines have two types of fuel injection valves: a port injection valve, which injects fuel into the intake port, and a direct injection valve, which injects fuel into the cylinder. In this type of engine, the injection distribution control is executed in which the ratio of the fuel injection amounts from the two types of fuel injection valves is varied depending on the operating state of the engine. Since the port injection valve and the direct injection valve of such an engine have different tendencies in variations of the injection characteristics, the learning of the air-fuel ratio learning value is also preferably executed separately for each type of the fuel injection valves. The learning of the air-fuel ratio learning value for each type of the fuel injection valves can be executed by forcibly executing fuel injection only from one of the fuel injection valves.

Japanese Laid-Open Patent Publication No. 2005-307756 discloses a fuel injection control device. In a learning region in which neither learning of an air-fuel ratio learning value for the port injection nor learning of an air-fuel ratio learning value for the direct injection valve has been completed, the fuel-injection control device preferentially executes the learning of the air-fuel ratio learning value for the fuel injection that is set to have a greater fuel injection amount ratio in the setting of the injection distribution ratio in that learning region. During the injection distribution control, the deviation of the injection characteristics affects the air-fuel ratio to a greater extent in the fuel injection valve in which the ratio of the fuel injection amount is set to a great value than in the fuel injection valve in which the ratio is set to a small value. Therefore, if the completion of final learning occurs simultaneously, that is, if the learning of the air-fuel ratio learning values for both fuel injections is completed at the same time, the effects of the learning are obtained at an earlier stage when the learning of the air-fuel ratio learning value is executed in the order of the fuel injection having the larger ratio of the fuel injection amount and the fuel injection having the smaller ratio of the fuel injection amount than when the learning is executed in the reverse order.

As described above, in the fuel injection control device for an engine disclosed in the above publication, it is possible to cause the learning to take effect from an earlier stage on the condition that the final completion of learning occurs at the same time. However, when the learning of the air-fuel ratio learning value for the fuel injection of which the ratio of the fuel injection amount is set to a greater value is prioritized as described above, the final completion of learning may be delayed. This will delay the time at which the learning takes effect.

SUMMARY OF THE INVENTION

It is an objective of the present invention to provide a fuel injection control device and method for an engine capable of readily completing learning of two air-fuel ratio learning values for port injection and direct injection.

To achieve the foregoing objective, a fuel injection control device for an engine is provided. The engine includes a port injection valve that injects fuel into an intake port and a direct injection valve that injects fuel into a cylinder. The fuel injection control device includes a distribution ratio calculation section, a learning control section, and an injection control section. The distribution ratio calculation section is configured to calculate, in accordance with an engine operating state, an injection distribution ratio that is a ratio between a port injection amount, which is an amount of fuel injected from the port injection valve, and a direct injection amount, which is an amount of fuel injected from the direct injection valve. The learning control section is configured to learn a port injection learning value, which is an air-fuel ratio learning value for port injection, and a direct injection learning value, which is an air-fuel ratio learning value for direct injection, separately for each of a plurality of learning regions that are divided according to the engine operating state. The learning control section executes a port injection learning process to learn the port injection learning value in response to satisfaction of a specified port injection learning condition after changing the injection distribution ratio such that a ratio of the port injection amount becomes 100% and a ratio of the direct injection amount becomes 0%. The learning control section executes a direct injection learning process to learn the direct injection learning value in response to satisfaction of a specified direct injection learning condition after changing the injection distribution ratio such that the ratio of the port injection amount becomes 0% and the ratio of the direct injection amount becomes 100%. The injection control section is configured to distribute a total amount of fuel to be used for combustion in the cylinder to the port injection amount and the direct injection amount in accordance with the injection distribution ratio, correct the distributed port injection amount and direct injection amount using the port injection learning value and the direct injection learning value, respectively, and control fuel injection of the port injection valve and fuel injection of the direct injection valve based on the corrected port injection amount and the corrected direct injection amount, respectively. The learning control section is configured such that, when the port injection learning condition and the direct injection learning condition are both satisfied in a learning region in which neither the learning of the port injection learning value nor the learning of the direct injection learning value has been completed, the learning control section executes the port injection learning process if the ratio of the port injection amount in the injection distribution ratio calculated by the distribution ratio calculation section is less than the ratio of the direct injection amount, and executes the direct injection learning process if the ratio of the direct injection amount in the injection distribution ratio is less than the ratio of the port injection amount.

As described above, the learning control section learns the air-fuel ratio learning value while setting, to 100%, the injection ratio of the fuel injection to be learned. In the case of executing the port injection learning process in the engine operating state in which the injection distribution ratio is set such that the ratio of the port injection amount is 80%, it is only necessary to increase the ratio of the port injection amount from 80% to 100%. In contrast, in the case of executing the port injection learning process in the engine operating state in which the injection distribution ratio is set such that the ratio of the port injection amount is 20%, it is necessary to increase the ratio of the port injection amount from 20% to 100%. Such a large change in the injection distribution ratio has a large influence on the combustion in the engine and the like and can be executed only in limited situations in many cases. For this reason, regarding the distribution ratio calculated by the distribution ratio calculation section, the learning condition of the fuel injection in which the ratio of the fuel injection amount is set to a small value tends to be less likely to be satisfied than the learning condition of the fuel injection in which the ratio of the fuel injection amount is set to a great value. That is, regarding the distribution ratio calculated by the distribution ratio calculation section in accordance with the operating state of the engine, the air-fuel ratio learning value for the fuel injection in which the ratio of the fuel injection amount is set to a small value tends to be learned less frequently than the air-fuel ratio learning value for the fuel injection in which the ratio of the fuel injection amount is set to a great value.

Regarding the distribution ratio calculated by the distribution ratio calculation section in accordance with the operating state of the engine, the air-fuel ratio learning value of the fuel injection in which the ratio of the fuel injection amount is set to a small value is defined as a learning value A, and the air-fuel ratio learning value of the fuel injection in which the ratio of the fuel injection amount is set to a great value is defined as a learning value B. If the learning of the learning value B is prioritized over the learning of the learning value A, the learning of the learning value A is not executed as long as the learning condition of the learning value B is satisfied even if the learning condition of the learning value A is satisfied in a period until the completion of the learning of the learning value B. That is, the learning of the learning value B eliminates the opportunities for learning of the learning value A, which are inherently rare. In some cases, the learning opportunities for the learning value A, which are inherently rare, may scarcely come around even after completion of learning of the learning value B. In such a case, even if the learning of the learning value B is completed at an early stage, learning of the learning value A cannot be completed until a later stage.

In this regard, when the port injection learning condition and the direct injection learning condition are both satisfied in the learning region in which neither learning of the port injection learning value nor learning of the direct injection learning value have been completed, the above-described learning control section executes the port injection learning process if the ratio of the port injection amount in the distribution ratio calculated by the distribution ratio calculation section is smaller than the ratio of the direct injection amount, and the learning control section executes the direct injection learning process if the ratio of the direct injection amount in the injection distribution ratio is smaller than the ratio of the port injection amount. That is, in a situation where the learning of the air-fuel ratio learning values for both the port injection and the direct injection is incomplete and it is possible to select one of the air-fuel ratio learning values to learn, the learning of the air-fuel ratio learning value having less learning opportunities is preferentially executed. In such a case, even if the opportunities for the learning of the learning value B, which are frequent, are reduced by the learning of the learning value A, which has less learning opportunities, completion of the learning of the learning value B, which inherently has many learning opportunities, will not be significantly delayed. Therefore, the learning of the two air-fuel ratio learning values for the port injection and direct injection can be completed more promptly.

The nozzle hole of the direct injection valve, which is exposed to combustion in the cylinder, is cooled by the fuel injected through the nozzle hole, takes the heat away. If the ratio of the fuel injection amount of the direct injection is set to 0% for the port injection learning process, the cooling by injected fuel will not be executed, and the nozzle hole of the direct injection valve may be excessively heated. In order to reliably avoid such heating of the nozzle hole of the direct injection valve, the port injection learning process, which is executed by stopping the direct injection, cannot be executed in the engine operation region where the nozzle hole tends to be excessively heated.

To cope with such a problem, the learning control section is preferably configured to, when a temperature of a nozzle hole of the direct injection valve exceeds a specified value during execution of the port injection learning process, temporarily change the injection distribution ratio such that fuel injection from the direct injection valve is executed while continuing the port injection learning process. In such a case, the learning of the port injection learning value can be advanced while cooling the nozzle hole by the direct injection. This limits decrease in the learning opportunities for the port injection learning value.

In order to reduce the influence on the learning of the port injection learning value, it is desirable to minimize the amount of the temporary direct injection at this time. In this respect, the learning control section sets the injection distribution ratio for the temporary change based on the temperature of the nozzle hole of the direct injection valve. This allows the injection distribution ratio to be set such that the ratio of the direct injection amount becomes small within a range in which the nozzle hole can be cooled to a temperature lower than or equal to the specified value.

The amount of fuel injected by the direct injection valve per unit time increases as the fuel supply pressure to the direct injection valve increases. In addition, the fuel injection time of the direct injection valve structurally has a minimum value (minimum injection time), and the direct injection valve cannot execute fuel injection at an amount smaller than the minimum injection amount determined by the minimum injection time and the fuel supply pressure. In contrast, the fuel supply pressure of the direct injection valve is variably controlled in some cases. Specifically, during high-load operation of the engine, in which the direct injection amount is great, the fuel supply pressure is increased to promote atomization of fuel. During low-load operation of the engine, in which the direct injection amount is reduced, the fuel supply pressure is lowered to reduce the minimum injection amount, thereby allowing for a small amount of the direct injection. In this configuration, immediately after the engine load suddenly drops, the fuel supply pressure may not be reduced in time, so that the total amount of fuel to be used for combustion in the cylinder becomes less than or equal to the minimum injection amount for the direct injection valve. In this case, even if the other conditions are satisfied, the direct injection learning process may not be executed. This reduces the learning opportunities for the direct injection learning value in the learning region where the total amount of fuel is less than a certain level.

To cope with such a problem, a fuel pressure control section is preferably provided, which is configured to variably control a fuel supply pressure to the direct injection valve. The fuel pressure control section is preferably configured to, when the learning of the direct injection learning value has not been completed in a learning region in which the total amount of fuel is less than or equal to the specified value, set an upper limit value of a control range of the fuel supply pressure to be lower than that in a state in which the learning has been completed. With this configuration, when the learning of the direct injection learning value in the learning region where the total amount of fuel is small has not been completed, the upper limit value of the fuel supply pressure is suppressed to be lower than usual. This shortens, even when the engine load suddenly drops, the time required to lower the fuel supply pressure until the minimum injection amount of the direct injection valve becomes lower than or equal to the total amount of fuel. Therefore, it is possible to increase the opportunities to learn the direct injection learning value in the learning region where the total amount of fuel is small.

In learning of the air-fuel ratio learning value from the initial value (hereinafter referred to as initial learning), it takes a longer time to learn the direct injection learning value in the learning region where the total amount of fuel is small as described above. Here, the direct injection learning value in a learning region in which the total amount of fuel is less than or equal to the specified value is defined as a learning value X. At this time, the learning control section is configured to, when an initial learning of the learning value X has not been completed, set the upper limit value of the control range of the fuel supply pressure to be even lower than that in a state in which the learning of the learning value X for second and subsequent times has not been completed. In such a case, the direct injection learning condition of the learning value X is more likely to be satisfied at the time of the initial learning, and learning opportunities increase. This shortens the time required to complete the initial learning.

To achieve the foregoing objective, a fuel injection control method for an engine is provided. The engine includes a port injection valve that injects fuel into an intake port and a direct injection valve that injects fuel into a cylinder. The fuel injection control method includes: calculating, in accordance with an engine operating state, an injection distribution ratio that is a ratio between a port injection amount, which is an amount of fuel injected from the port injection valve, and a direct injection amount, which is an amount of fuel injected from the direct injection valve; and learning a port injection learning value, which is an air-fuel ratio learning value for port injection, and a direct injection learning value, which is an air-fuel ratio learning value for direct injection, separately for each of a plurality of learning regions that are divided according to the engine operating state. The learning of the port injection learning value includes executing the learning of the port injection learning value in response to satisfaction of a specified port injection learning condition after changing the injection distribution ratio such that a ratio of the port injection amount becomes 100% and a ratio of the direct injection amount becomes 0%. The learning of the direct injection learning value includes executing the learning of the direct injection learning value in response to satisfaction of a specified direct injection learning condition after changing the injection distribution ratio such that the ratio of the port injection amount becomes 0% and the ratio of the direct injection amount becomes 100%. The method further includes: distributing a total amount of fuel to be used for combustion in the cylinder to the port injection amount and the direct injection amount in accordance with the injection distribution ratio; correcting the distributed port injection amount and direct injection amount using the port injection learning value and the direct injection learning value, respectively; and controlling fuel injection of the port injection valve and fuel injection of the direct injection valve based on the corrected port injection amount and the corrected direct injection amount, respectively. When the port injection learning condition and the direct injection learning condition are both satisfied in a learning region in which neither the learning of the port injection learning value nor the learning of the direct injection learning value has been completed, the learning of the port injection learning value is executed if the ratio of the port injection amount in the calculated injection distribution ratio is less than the ratio of the direct injection amount, and the learning of the direct injection learning value is executed if the ratio of the direct injection amount in the injection distribution ratio is less than the ratio of the port injection amount.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DESCRIPTION OF THE PREFERRED EMBODIMENTS

A fuel injection control device for an engine according to one embodiment will be described with reference to FIGS. 1 to 15.

Figure 1:
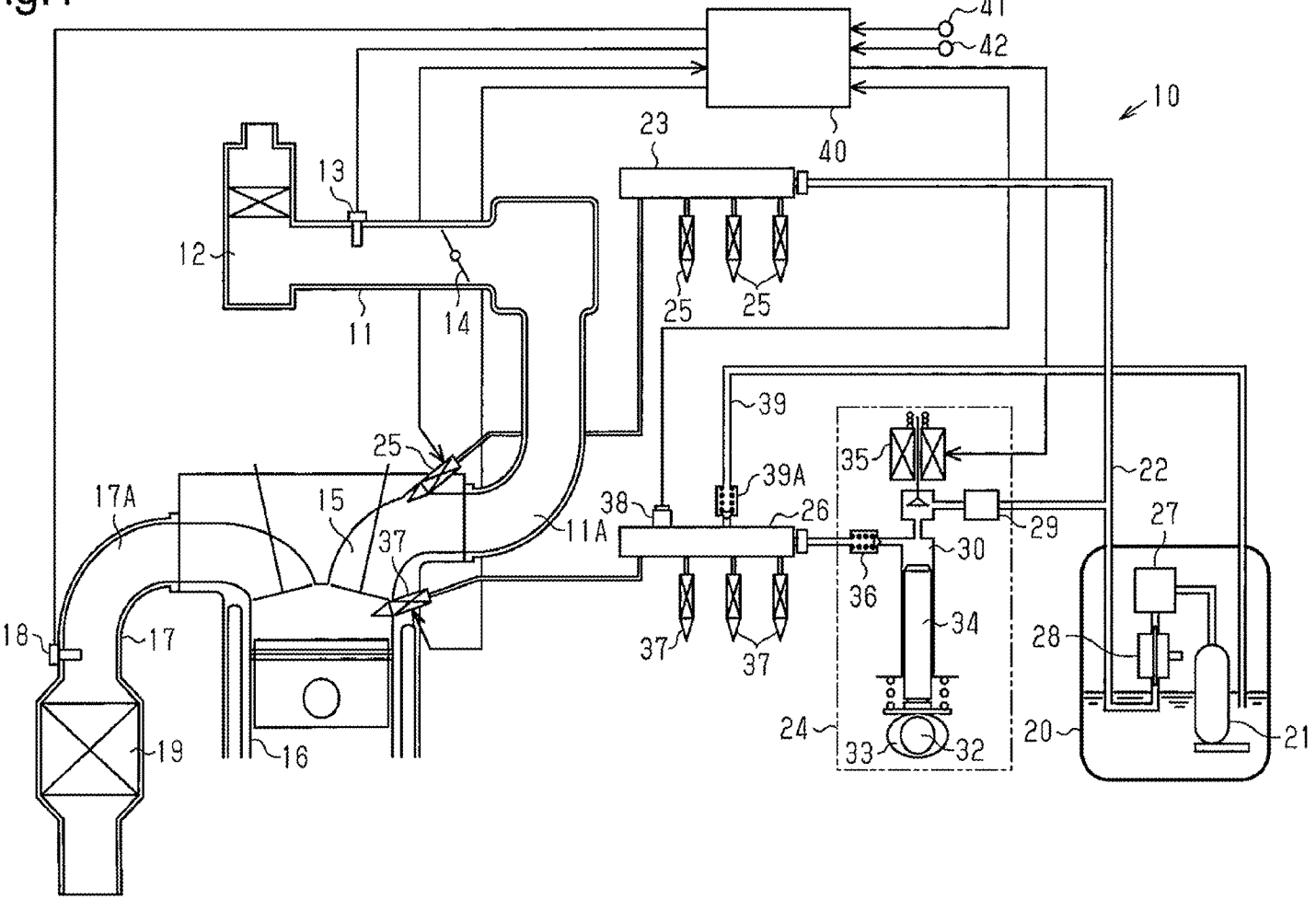
FIG. 1 is a schematic diagram showing a fuel injection control device according to one embodiment and an engine.

FIG. 1 illustrates an engine 10, which includes an intake passage 11, in which are provided an air cleaner 12, an air flow meter 13, a throttle valve 14, and an intake manifold 11A in the order from the upstream side. The air cleaner 12 filters out dust and the like from intake air flowing into the intake passage 11. The air flow meter 13 detects the flow rate of the intake air (an intake air amount GA). The throttle valve 14 adjusts the intake air amount GA by changing the opening degree. The intake passage 11 is branched into multiple passages in the intake manifold 11A and then connected to cylinders 16 through intake ports 15 provided in the respective cylinders 16.

The engine 10 also includes an exhaust passage 17, in which are provided an exhaust manifold 17A, an air-fuel ratio sensor 18, and a catalyst device 19 in the order from the upstream side. The exhaust gas discharged from the cylinders 16 to the exhaust passage 17 merges at the exhaust manifold 17A and flows into the catalyst device 19 and is purified in the catalyst device 19. The air-fuel ratio sensor 18 outputs a signal corresponding to components in the exhaust gas flowing into the catalyst device 19. The components in the exhaust gas reflect the air-fuel ratio of the air-fuel mixture to be burned in the cylinders 16.

The fuel supply system of the engine 10 includes a feed pump 21 for pumping out and discharging fuel from a fuel tank 20. The feed pump 21 is connected to a low-pressure fuel pipe 23 and a high-pressure fuel pump 24 via a low-pressure fuel passage 22. The low-pressure fuel pipe 23 is a fuel container for storing the fuel delivered from the feed pump 21 and is connected to port injection valves 25 for the respective cylinders 16 of the engine 10. The port injection valves 25 are each configured as an electromagnetic fuel injection valve that injects the fuel stored in the low-pressure fuel pipe 23 into the intake port 15 of the engine 10 in response to energization. The high-pressure fuel pump 24 further pressurizes the fuel delivered from the feed pump 21 and discharges it to a high-pressure fuel pipe 26. The low-pressure fuel passage 22 is provided with a filter 27 for filtering the fuel discharged by the feed pump 21 and a pressure regulator 28. The pressure regulator 28 opens when the fuel pressure (feed pressure) in the low-pressure fuel passage 22 exceeds a specified relief pressure to release the fuel in the low-pressure fuel passage 22 into the fuel tank 20.

The high-pressure fuel pump 24 has two volume portions, which are a fuel gallery 29 and a pressurizing chamber 30. The fuel delivered from the feed pump 21 through the low-pressure fuel passage 22 is introduced to the fuel gallery 29. The fuel gallery 29 contains a pulsation damper for damping the pulsation of the fuel pressure. Furthermore, the high-pressure fuel pump 24 includes a plunger 34, which is reciprocated by a pump driving cam 33 provided on a camshaft 32 of the engine 10 to change the volume of the pressurizing chamber 30.

The fuel gallery 29 and the pressurizing chamber 30 are connected to each other via an electromagnetic spill valve 35. The electromagnetic spill valve 35 is a normally open valve that closes in response to energization. When opened, the electromagnetic spill valve 35 connects the fuel gallery 29 and the pressurizing chamber 30 to each other. When closed, the electromagnetic spill valve 35 disconnects the fuel gallery 29 and the pressurizing chamber 30 from each other. Further, the pressurizing chamber 30 communicates with the high-pressure fuel pipe 26 via a check valve 36. When the pressure in the pressurizing chamber 30 is higher than the pressure in the high-pressure fuel pipe 26, the check valve 36 opens to allow fuel to be discharged from the pressurizing chamber 30 to the high-pressure fuel pipe 26. When the pressure in the high-pressure fuel pipe 26 is higher than the pressure in the pressurizing chamber 30, the check valve 36 is closed to restrict backflow of fuel from the high-pressure fuel pipe 26 to the pressurizing chamber 30.

The high-pressure fuel pipe 26 is a fuel container for storing high-pressure fuel delivered from the high-pressure fuel pump 24 and is connected to the direct injection valve 37 installed in each cylinder 16 of the engine 10. The direct injection valve 37 is configured as an electromagnetic fuel injection valve that injects fuel stored in the high-pressure fuel pipe 26 into the cylinder 16 in response to energization. A fuel pressure sensor 38 is attached to the high-pressure fuel pipe 26. The fuel pressure sensor 38 detects the pressure of the fuel in the high-pressure fuel pipe 26, that is, fuel supply pressure to the direct injection valves 37 (hereinafter, referred to as fuel pressure PM). In addition, a relief valve 39A is attached to the high-pressure fuel pipe 26. When the internal pressure of the high-pressure fuel pipe 26 increases to an excessive level, the relief valve 39A opens to release the fuel into the fuel tank 20 through a relief passage 39.

The fuel injection control device of the present embodiment, which is employed in the engine 10, includes an electronic control unit 40. The electronic control unit 40 includes a central processing unit, which executes various computation processes, a read-only memory, in which programs and data for the computation processes are stored in advance, and a random access memory, which temporarily stores computation results of the central processing unit, detection results of various sensors, and the like. Also, the electronic control unit 40 includes a backup memory, which remains energized and retains stored data even when the main relay of the electronic control unit 40 is turned off. Such stored data in the backup memory is erased when the battery is removed for repair or the like. The phenomenon that the stored data in the backup memory is cleared at the removal of the battery is referred to as "battery-removal memory clearance".

In addition to detection signals from the above-described air flow meter 13, air-fuel ratio sensor 18, and fuel pressure sensor 38, the electronic control unit 40 receives detection signals from sensors such as a rotational speed sensor 41, which detects the rotational speed of the engine 10 (the engine speed NE), and a throttle sensor 42, which detects the opening degree of the throttle valve 14 (the throttle opening degree TA). Based on the detection results of these sensors, the electronic control unit 40 controls the engine 10 by driving the high-pressure fuel pump 24, the port injection valves 25, and the direct injection valves 37.

The electronic control unit 40 controls the fuel injection executed by the port injection valves 25 and the direct injection valves 37 as part of the control of the engine 10. In the present embodiment, the fuel pressure control that varies the fuel pressure PM of the direct injection valves 37 in accordance with the operating state of the engine 10 is implemented as part of such fuel injection control.

Figure 2:
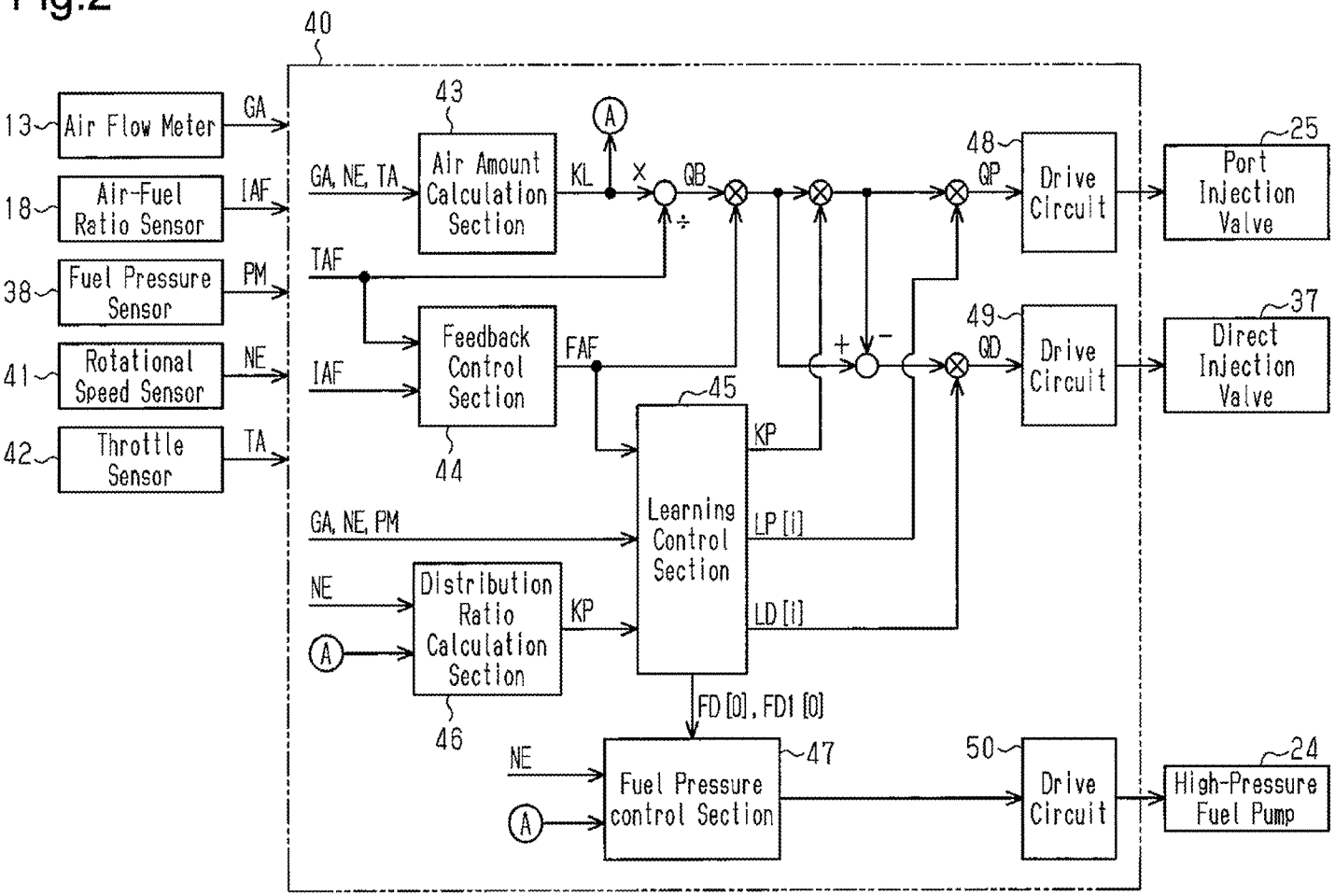
FIG. 2 is a block diagram schematically showing the fuel injection control device of FIG. 1.

FIG. 2 is a block diagram showing a configuration related to the fuel injection control in the electronic control unit 40. As shown in the drawing, the electronic control unit 40 includes an air amount calculation section 43, a feedback (F/B) control section 44, a learning control section 45, a distribution ratio calculation section 46, and a fuel pressure control section 47. The electronic control unit 40 also includes a drive circuit 48 for the port injection valves 25, a drive circuit 49 for the direct injection valves 37, and a drive circuit 50 for the high-pressure fuel pump 24.

The air amount calculation section 43 calculates the amount of air drawn into the cylinder 16 (a cylinder inflow air amount KL) during the intake stroke. The air amount calculation section 43 calculates the cylinder inflow air amount KL from the intake air amount GA, the engine speed NE, the throttle opening degree TA, and the like using a physical model of the intake behavior of the engine 10.

A requested injection amount QB, which is the requested value of the fuel injection amount, is obtained from the cylinder inflow air amount KL, which is calculated by the air amount calculation section 43, and a target air-fuel ratio TAF, which is a target value of the air-fuel ratio. Specifically, the value of the requested injection amount QB is determined such that the ratio of the requested injection amount QB to the cylinder inflow air amount KL is the reciprocal of the target air-fuel ratio TAF (QB=KL/TAF).

The feedback control section 44 executes air-fuel ratio feedback control on the fuel injection amount in order to adjust, to the target air-fuel ratio TAF, an air-fuel ratio that is the mass ratio of air to fuel in the air-fuel mixture burned in the cylinder 16. In the air-fuel ratio feedback control, in accordance with the difference between the value of the air-fuel ratio detected by the air-fuel ratio sensor 18 (the actual air-fuel ratio IAF) and the target air-fuel ratio TAF, the value of the air-fuel ratio feedback correction factor FAF is updated to approach the value reducing the difference. The value of the air-fuel ratio feedback correction factor FAF is obtained as a factor by which the requested injection amount QB is multiplied. The value of the air-fuel ratio feedback correction factor FAF is 1 when the actual air-fuel ratio IAF has converged to the target air-fuel ratio TAF. The value of the air-fuel ratio feedback correction factor FAF is set to a value greater than 1 when the actual air-fuel ratio IAF is a value greater than the target air-fuel ratio TAF (a value on the lean side), and is set to a value less than 1 when the actual air-fuel ratio IAF is a value less than the target air-fuel ratio TAF (a value on the rich side).

The learning control section 45 executes air-fuel ratio learning control. In the air-fuel ratio learning control, from the result of the air-fuel ratio feedback control, the learning control section 45 obtains and stores, as an air-fuel ratio learning value, a correction value of the requested injection amount QB, which is necessary for matching the actual air-fuel ratio IAF with the target air-fuel ratio TAF. In the present embodiment, five separate learning regions are divided according to the intake air amount GA, which is a parameter indicating the engine operating state. For each of the five learning regions, the learning control section 45 separately learns two air-fuel ratio learning values, which are a learning value for fuel injection of the port injection valve 25 (port injection) and a learning value for fuel injection of the direct injection valve 37 (direct injection). That is, in the present embodiment, learning of ten air-fuel ratio learning values is executed in the air-fuel ratio learning control.

In the following description, the five learning regions are distinguished by assigning identification numbers 0, 1, 2, 3, and 4 to the five regions, respectively. The greater the intake air amount GA in a learning region, the greater the identification number set for that region becomes. In the following description, the air-fuel ratio learning value for port injection in the learning region of which the identification number is i is represented by a port injection learning value LP[i], and the air-fuel ratio learning value for direct injection in the learning region of which the identification number is i is represented by a direct injection learning value LD[i]. The values of the port injection learning value LP[i] and the direct injection learning value LD[i] are stored in the backup memory of the electronic control unit 40.

The distribution ratio calculation section 46 calculates an injection distribution ratio KP in accordance with the operating state of the engine 10 (the engine speed NE and the cylinder inflow air amount KL). The injection distribution ratio KP is the ratio between the port injection amount QP, which is the amount of fuel injected from the port injection valve 25, and the direct injection amount QD, which is the amount of fuel injected from the direct injection valve 37. The value of the injection distribution ratio KP is obtained as the ratio of the port injection amount QP to the sum of the port injection amount QP and the direct injection amount QD, that is, to the total amount of fuel to be used for combustion in the cylinder 16. Thus, the value (1−KP) obtained by subtracting the value of the injection distribution ratio KP from 1 is the ratio of the direct injection amount QD to the total amount of fuel. When the injection distribution ratio KP is 1, all the fuel to be used for combustion is injected from the port injection valve 25. When the injection distribution ratio KP is 0, all the fuel to be used for combustion is injected from the direct injection valve 37.

Figure 3:
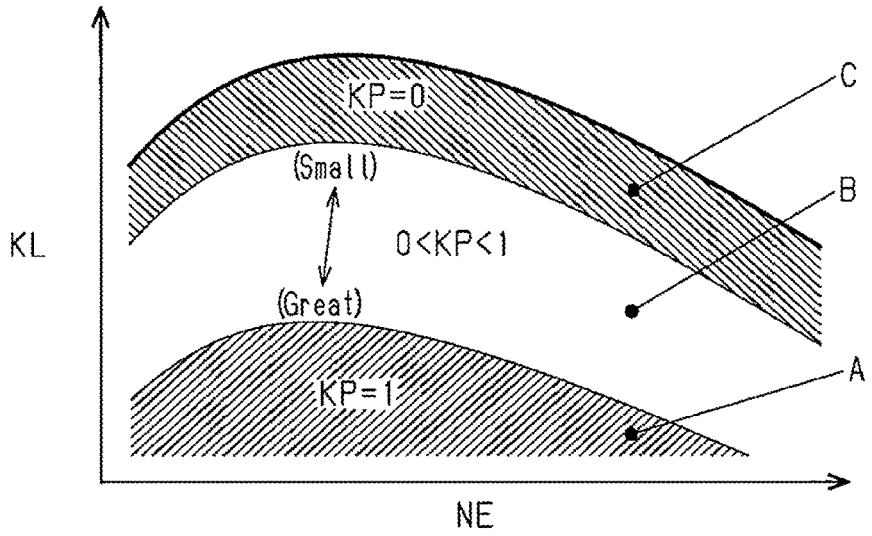
FIG. 3 is a graph showing the relationship of an injection distribution ratio KP with an engine speed NE and a cylinder inflow air amount KL.

FIG. 3 shows a manner of setting the injection distribution ratio KP in the present embodiment. Of three regions A, B, and C shown in FIG. 3, the region A, which is located on the side of smaller values of the cylinder inflow air amount KL, is a port injection region, in which the value of the injection distribution ratio KP is set to 1 so that all the fuel injection is executed by the port injection. Of the three regions, the region C, which is located on the side of greater values of the cylinder inflow air amount KL, is a direct injection region, in which the value of the injection distribution ratio KP is set to 0, so that all the fuel injection is executed by the direct injection. The region B, which is located between the region A and the region C, is an injection distribution region, in which fuel injection is executed separately by the port injection and the direct injection. In the region B (the injection distribution region), the value of the injection distribution ratio KP approaches 1 toward the region A and approaches 0 toward the region C.

As described above, in the present embodiment, when the engine speed NE is the same, the greater the cylinder inflow air amount KL, the smaller the value of the injection distribution ratio KP becomes, that is, the greater becomes the ratio of the direct injection amount QD to the total amount of fuel injection. The reason for this is as follows.

In the region where the cylinder inflow air amount KL is great, the amount of heat generated by combustion increases, so that the temperature in the cylinder 16 increases. As a result, the inflow efficiency of the intake air to the cylinder 16 decreases due to the thermal expansion of the intake air in the cylinder 16. In contrast, when fuel is injected from the direct injection valve 37 into the intake air in the cylinder 16, the temperature of the intake air in the cylinder 16 is lowered by the heat of vaporization the fuel. Therefore, in the region where the cylinder inflow air amount KL is great, the ratio of the fuel injection amount of the direct injection valve 37 is increased to limit the decrease in the inflow efficiency of the intake air.

In contrast, the fuel injected from the port injection valve 25 is mixed with intake air in both the intake port 15 and the cylinder 16, whereas the fuel injected from the direct injection valve 37 is mixed with intake air only in the cylinder 16. Thus, when the cylinder inflow air amount KL, that is, the flow rate of the intake air flowing into the cylinder 16 is small, mixing of the fuel injected from the direct injection valve 37 and the intake air tends to be insufficient. Therefore, in a region where the cylinder inflow air amount KL is small, the ratio of the fuel injection amount of the port injection valve 25 is increased to suppress deterioration of combustion due to insufficient mixing of fuel and intake air.

The fuel injection control device of the present embodiment as described above calculates the port injection amount QP and the direct injection amount QD such that the conditions expressed by the following equations are satisfied based on the cylinder inflow air amount KL, the air-fuel ratio feedback correction factor FAF, the port injection learning value LP[i], the direct injection learning value LD[i], the injection distribution ratio KP, and the target air-fuel ratio TAF. The drive circuit 48 drives the port injection valve 25 to inject fuel corresponding to the calculated port injection amount QP, and the drive circuit 49 drives the direct injection valve 37 to inject fuel corresponding to the calculated direct injection amount QD. The fuel injection is thus executed.

$$QP=QB\times FAF\times KP\times LP[i]$$

$$QD=QB\times FAF\times(1-KP)\times LD[i]$$

$$QB=KL/TAF$$

That is, the fuel injection control device of the present embodiment controls the fuel injection from the port injection valve 25 and the direct injection valve 37 in the following manner. First, the requested injection amount QB is calculated as the total amount of fuel to be used for combustion in the cylinder 16. Subsequently, in order to compensate for the deviation between the requested injection amount QB and the amount of fuel that is actually injected, the requested injection amount QB is corrected using the air-fuel ratio feedback correction factor FAF, and the value obtained through the correction (QB×FAF) is distributed into the port injection amount and the direct injection amount according to the injection distribution ratio KP calculated by the distribution ratio calculation section 46. The value of the port injection amount at this point is a value obtained by multiplying the corrected value (QB×FAF) by the injection distribution ratio KP, and the value of the direct injection amount is set a value obtained by multiplying the corrected value by (1−KP). Further, the value obtained by correcting the value of the port injection amount after such distribution using the port injection learning value LP[i] is calculated as the final port injection amount QP, and the value obtained by correcting the value of the direct injection amount using the direct injection learning value LD[i] after the distribution is calculated as the final direct injection amount QD. Then, by driving the port injection valve 25 and the direct injection valve 37 respectively in accordance with the calculated port injection amount QP and the direct injection amount QD, the fuel injection of the port injection valve 25 and the direct injection valve 37 is controlled. The electronic control unit 40 functions as an injection control section that controls fuel injection as described above.

<Fuel Pressure Control>

The fuel pressure control section 47 executes fuel pressure control for controlling the fuel pressure PM of the direct injection valve 37. In the fuel pressure control, in accordance with a target value of the fuel pressure PM set according to the operating state of the engine 10 (hereinafter, referred to as a target fuel pressure PT), the fuel discharge amount of the high-pressure fuel pump 24 is adjusted such that the value of the fuel pressure PM detected by the fuel pressure sensor 38 becomes the target fuel pressure PT.

The greater the cylinder inflow air amount KL or the higher the engine speed NE, the higher the target fuel pressure PT is set. The reason for this is as follows.

The direct injection valve 37 energizes the built-in electromagnetic solenoid to open the nozzle, thereby injecting the fuel. The fuel injection at this time is executed in accordance with the pressure difference between the fuel pressure PM and the pressure in the cylinder 16. Thus, the higher the fuel pressure PM, the greater becomes the fuel injection amount per unit time of the direct injection valve 37 (hereinafter, referred to as a fuel injection rate).

In order to avoid deterioration of combustion due to adhesion of fuel to the top face of the piston and insufficient stirring of fuel with intake air, it is necessary to execute the fuel injection of the direct injection valve 37 within a limited period of time in the combustion cycle (hereinafter, referred to as an injectable period). Therefore, when the cylinder inflow air amount KL is great and a great amount of fuel injection is requested, or when the engine speed NE is high and the combustion cycle is short, the target fuel pressure PT is set to a high pressure so as to increase the fuel injection ratio of the direct injection valve 37 and complete the necessary amount of fuel injection within the injectable period.

The energization time of the electromagnetic solenoid of the direct injection valve 37 structurally has a minimum value. The fuel injection amount within the minimum time is the lower limit (the minimum injection amount) of the fuel injection amount of the direct injection valve 37. On the other hand, as described above, the fuel injection amount per unit time of the direct injection valve 37 increases as the fuel pressure PM increases. Thus, if the fuel pressure PM is high when a small amount of fuel injection is requested, the minimum injection amount, which is determined by the shortest energization time of the electromagnetic solenoid, is greater than the requested fuel injection amount, and fuel cannot be injected as requested. Therefore, when the cylinder inflow air amount KL is small and a small amount of fuel injection is requested, the target fuel pressure PT is set to a low pressure in order to reduce the minimum injection amount of the direct injection valve 37.

The fuel pressure PM, that is, the fuel pressure in the high-pressure fuel pipe 26 is changed in accordance with the balance between the fuel discharge amount from the high-pressure fuel pump 24 to the high-pressure fuel pipe 26 and the consumed amount of fuel in the high-pressure fuel pipe 26 due to the fuel injection of the direct injection valve 37. Thus, in the fuel pressure control, when the fuel pressure PM detected by the fuel pressure sensor 38 is lower than the target fuel pressure PT, the electronic control unit 40 increases the fuel pressure PM by increasing the fuel discharge amount of the high-pressure fuel pump 24 to be greater than the fuel consumption amount due to the fuel injection of the direct injection valve 37. Also, in the fuel pressure control, when the fuel pressure PM detected by the fuel pressure sensor 38 is higher than the target fuel pressure PT, the electronic control unit 40 decreases the fuel pressure PM by decreasing the fuel discharge amount of the high-pressure fuel pump 24 to be smaller than the fuel consumption amount due to the fuel injection of the direct injection valve 37.

<Air-Fuel Ratio Learning Control>

Next, the details of the air-fuel ratio learning control executed by the learning control section 45 will be described. In the present embodiment, learning of the port injection learning value LP[i] is executed after changing the injection distribution ratio KP to 1 from the value calculated by the distribution ratio calculation section 46, except for the case of executing the direct injection as a temporary exceptional measure in a protective injection control, which will be discussed below. That is, learning of the port injection learning value LP[i] is executed after setting the ratio of the port injection amount QP to the requested injection amount QB to 100% and setting the ratio of the direct injection amount QD to 0%.

In addition, learning of the direct injection learning value LD[i] is executed after changing the injection distribution ratio KP to 0 from the value calculated by the distribution ratio calculation section 46. That is, learning of the direct injection learning value LD[i] is executed after setting the ratio of the direct injection amount QD to the requested injection amount QB to 100% and setting the ratio of the port injection amount QP to 0%. As described above, in the present embodiment, learning of the port injection learning value LP[i] is executed in a state where fuel injection is executed through the port injection alone, and the learning of the direct injection learning value LD[i] is executed in a state where fuel injection is executed through the direct injection alone. This improves the learning accuracy of each learning value.

<Port Injection Learning Control>

Figure 4:
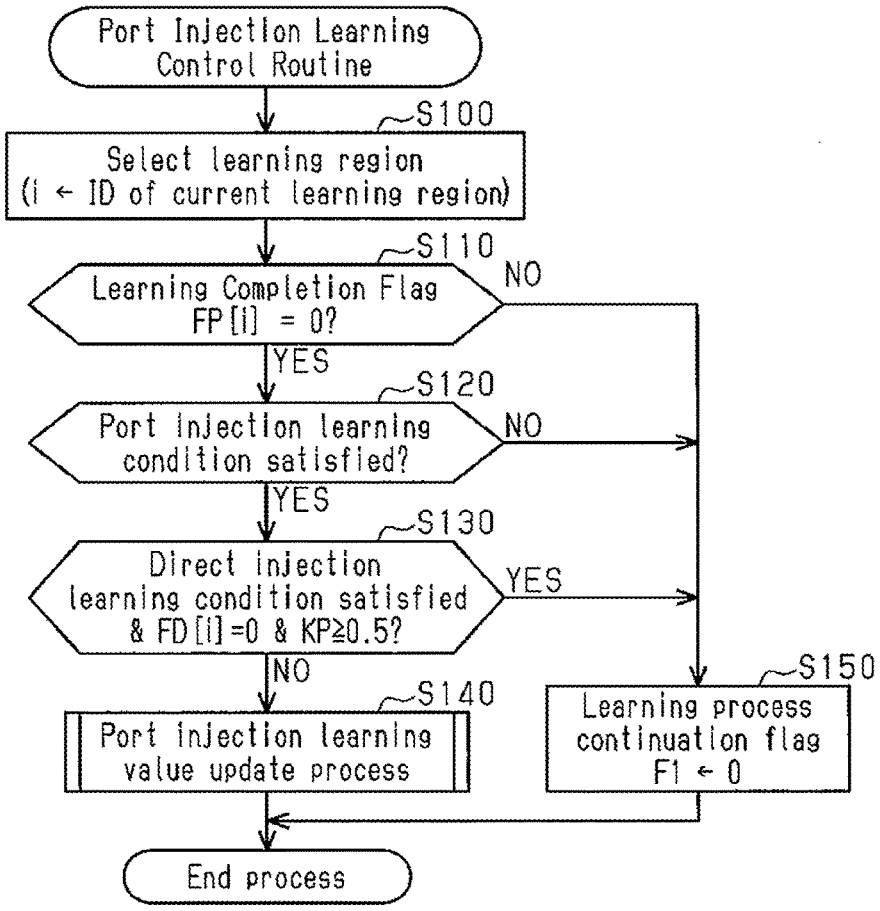
FIG. 4 is a flowchart of a port injection learning control routine executed by the learning control section of FIG. 2.

FIG. 4 shows a flowchart of a port injection learning control routine for learning the port injection learning value LP[i]. During the operation of the engine 10, the learning control section 45 repeatedly executes this routine at specified intervals.

When the process of this routine is started, a learning region is first selected at step S100. Specifically, it is determined which of the five learning regions the engine 10 is currently operating in, and the identification number (ID) of the learning region in which the engine 10 is currently operating is set as the value of the current learning region i.

Subsequently, at step S110, it is determined whether learning of the port injection learning value LP[i] in the current learning region i is incomplete. Specifically, the determination is made based on whether the value of a learning completion flag FP[i] is 0. The learning completion flag FP[i] is set for each learning region, and these values are cleared to 0 when the power supply of the electronic control unit 40 is turned off after operation of the engine 10 is stopped, and is set to 1 when learning of the port injection learning value LP[i] of the corresponding learning region is completed. Thus, at the start of the operation of the engine 10, it is assumed that, in all the learning regions, the value of the learning completion flag FP[i] is 0, that is, the learning of the port injection learning value LP[i] is incomplete.

If the learning of the port injection learning value LP[i] in the current learning region i has already been completed (S110: NO), the process proceeds to step S150. At step S150, the value of a learning process continuation flag F1 is cleared to 0, and then the process of this routine in the current cycle is ended. The learning process continuation flag F1 is a flag indicating that the port injection learning process for learning the port injection learning value LP[i] is in progress.

If learning of the port injection learning value LP[i] in the current learning region i is incomplete (S110: YES), it is determined at step S120 whether the port injection learning condition is satisfied. The port injection learning condition is satisfied when the following sub-conditions are satisfied: (1a) a learning precondition is satisfied; (1b) the engine speed NE and the cylinder inflow air amount KL are stable (the fluctuations are small); and (1c) fuel injection through the port injection alone is possible. The learning precondition is satisfied when there is no anomaly in the sensors used for learning or the direct injection valve 37. Fuel injection through the port injection alone is determined to be possible when fuel injection through the port injection alone would not cause combustion instability or the like. Due to such restrictions, the fuel injection through the port injection alone is possible only in part of the learning region depending on the learning region.

If the port injection learning condition is not satisfied (S 120: NO), the process of this routine in the current cycle is ended after the value of the learning process continuation flag F1 is cleared to 0 at the aforementioned step S150. In contrast, if the port injection learning condition is satisfied (S120: YES), the process proceeds to step S130.

When the process proceeds to step S130, at step S130, it is determined whether all the following sub-conditions are satisfied: (2a) a direct injection learning condition, which will be discussed below, is satisfied; (2b) learning of the direct injection learning value LD[i] in the current learning region has been completed; and (2c) the value of the injection distribution ratio KP calculated by the above-described distribution ratio calculation section 46 is greater than or equal to 0.5. Whether the learning of the direct injection learning value LD[i] has been completed is determined from the value of a learning completion flag FD[i], which will be discussed below. Further, the calculated value of the injection distribution ratio KP being 0.5 or greater means that the injection distribution ratio KP is set to a value with which the ratio of the direct injection amount QD to the total amount of fuel to be burned in the cylinder 16 (the requested injection amount QB) becomes smaller than the ratio of the port injection amount QP.

If all the sub-conditions (2a) to (2c) are satisfied (S130: YES), the process of this routine in the current cycle is ended after the value of the learning process continuation flag F1 is cleared to 0 at the aforementioned step S150. If at least one of the sub-conditions (2a) to (2c) is not satisfied at step S130 (NO), the process of this routine in the current cycle is ended after the port injection learning value update process is executed at step S140.

The learning control section 45 executes the port injection learning process for learning the port injection learning value LP[i] by repeatedly executing the port injection learning value update process. That is, in the port injection learning control routine, which is repeatedly executed, the port injection learning process is continued while a state continues in which the process proceeds to the step S140.

Figure 5:
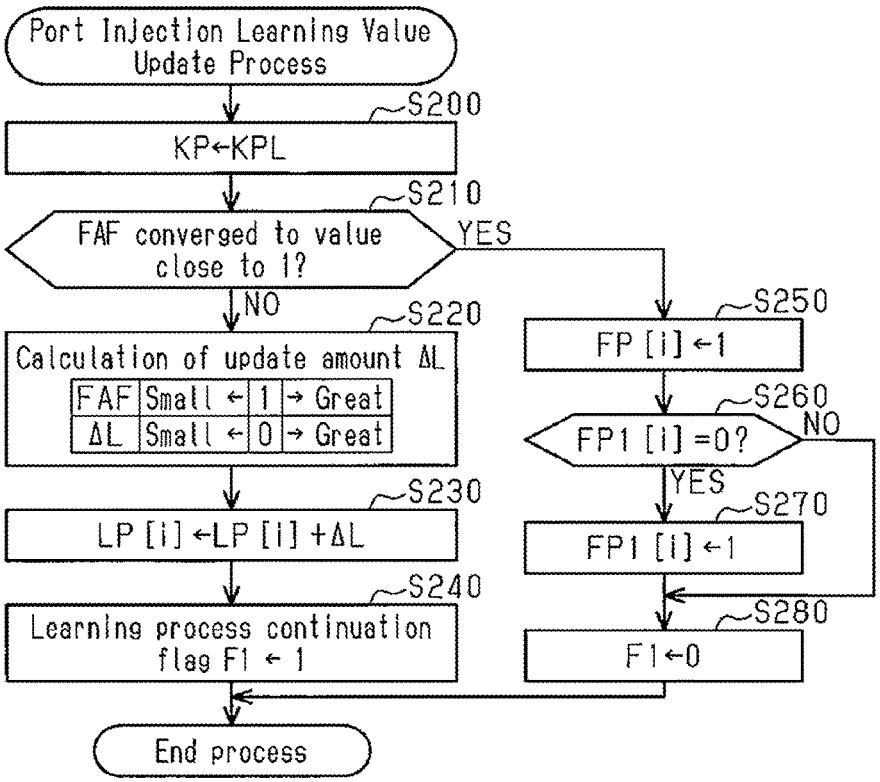
FIG. 5 is a flowchart of a port injection learning value update process executed by the learning control section of FIG. 2.

FIG. 5 shows a flowchart of the port injection learning value update process. As shown in FIG. 5, when this process is started, first, at step S200, the value of the injection distribution ratio KP is rewritten from the value calculated by the distribution ratio calculation section 46 to the value of a port injection learning distribution ratio KPL, which is set in a protective injection control, which will be discussed below. The port injection learning distribution ratio KLP is set to 1 except for the case of executing the direct injection as a temporary exceptional measure.

Subsequently, at step S210, it is determined whether the value of the air-fuel ratio feedback correction factor FAF has converged to a value close to 1. Specifically, this determination is made based on whether the state in which the value of the air-fuel ratio feedback correction factor FAF is greater than or equal to $(1-\alpha)$ and less than or equal to $(1+\alpha)$ has continued longer than a specified convergence determination time. The state in which the value of the air-fuel ratio feedback correction factor FAF has converged to a value close to 1 refers to a state in which the value of the port injection learning value LP[i] in the current learning region i has become a value required to cause the actual air-fuel ratio IAF to be the target air-fuel ratio TAF without executing correction through the air-fuel ratio feedback control. That is, the state of convergence means that learning of the port injection learning value LP[i] has been completed.

When it is determined that the value of the air-fuel ratio feedback correction factor FAF has not converged to a value close to 1 (S210: NO), an update amount ΔL for the port injection learning value LP[i] is calculated at step S220. The update amount ΔL is a negative value when the value of the air-fuel ratio feedback correction factor FAF is less than 1, and is a positive value when the value of the air-fuel ratio feedback correction factor FAF exceeds 1. In addition, as the deviation of the value of the air-fuel ratio feedback correction factor FAF from 1 increases, the value of the update amount ΔL is calculated such that the absolute value becomes greater.

Subsequently, at step S230, the value of the port injection learning value LP[i] in the current learning region i is updated to a value obtained by adding the update amount ΔL to the value before updating. Then, after the value of the learning process continuation flag F1 is set to 1 at step S240, the update process is ended.

In contrast, if it is determined that the value of the air-fuel ratio feedback correction factor FAF has converged to a value close to 1 at step S210 (YES), the value of the port injection learning completion flag FP[i] in the current learning region i is set to 1 at step S250. Then, after the value of the learning process continuation flag F1 is cleared to 0 at step S280, the update process is ended. At this time, if the value of an initial learning completion flag FP1[*i*] for the port injection in the current learning region i is 0 (S260: YES), a flag manipulation for setting the value of the initial learning completion flag FP1[*i*] to 1 is also executed at step S270 in addition to the flag manipulations in steps S250 and S280.

The value of the initial learning completion flag FP1[*i*] is stored in the backup memory and becomes 0, which is the initial value, at the time of factory shipment or battery-removal memory clearance. Therefore, after the learning of the value of the port injection learning value LP[i] is learned for the first time after factory shipment or battery-removal memory clearance, the value of the initial learning completion flag FP1[*i*] is held at 1 unless the storage of the backup memory is cleared due to removal of the battery.

<Direct Injection Learning Control>

Figure 6:
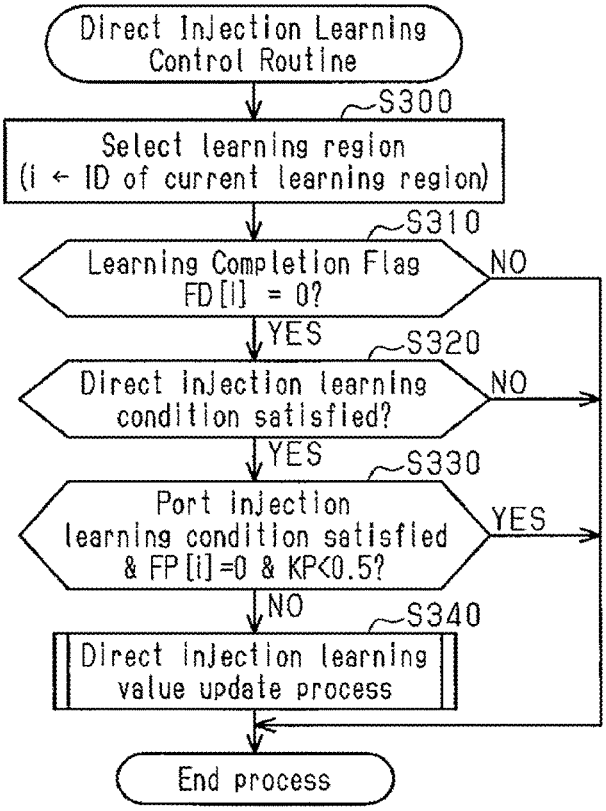
FIG. 6 is a flowchart of a direct injection learning control routine executed by the learning control section of FIG. 2.

FIG. 6 shows a flowchart of a direct injection learning control routine for learning the direct injection learning value LD[i]. During the operation of the engine 10, the learning control section 45 repeatedly executes this routine at specified intervals.

When the process of this routine is started, the learning region is first selected at step S300, and the value of the current learning region i is set to the identification number (ID) of the learning region in which the engine 10 is currently operating.

Subsequently, at step S310, it is determined whether the learning of the direct injection learning value LD[i] in the current learning region i is incomplete. This determination is made based on whether the value of the learning completion flag FD[i] for the direct injection in the current learning region i is 0. Similarly to the learning completion flag FP[i] used for determining the learning completion of the port injection learning value LP[i], the learning completion flag FD[i] is also provided for each learning region. The value of the learning completion flag FD[i] is also cleared to 0 when the power supply to the electronic control unit 40 is turned off after the operation of the engine 10 is stopped, and is set to 1 when the learning of the direct injection learning value LD[i] of the corresponding learning region is completed. If the learning of the direct injection learning value LD[i] in the current learning region i has already been completed (S310: NO), and the process of the current routine is ended.

In contrast, if the learning of the direct injection learning value LD[i] in the current learning region i has not been completed (S310: YES), it is determined at step S320 whether the direct injection learning condition is satisfied. The direct injection learning condition is satisfied when the following sub-conditions are satisfied: (1d) a learning precondition is satisfied; (1e) the engine speed NE and the cylinder inflow air amount KL are stable (the fluctuation is small); and (1f) fuel injection through the direct injection alone is possible. The learning precondition is the same as that in the sub-condition (1a) of the port injection learning condition. Fuel injection through the direct injection alone is determined to be possible when fuel injection through the direct injection alone would not cause combustion instability or the like.

If the direct injection learning condition is not satisfied (S320: NO), the process of the current routine is ended. In contrast, if the direct injection learning condition is satisfied (S320: YES), it is determined at step S330 whether all the following sub-conditions are satisfied: (2d) the port injection learning condition is satisfied; (2e) the learning of the port injection learning value LP[i] in the current learning region i has been completed; and (2f) the value of the injection distribution ratio KP calculated by the above-described distribution ratio calculation section 46 is less than 0.5. Whether the learning of the port injection learning value LP[i] has been completed in the current learning region i is determined from the value of the learning completion flag FD[i] for the port injection in the current learning region i. Further, the value of the injection distribution ratio KP being less than 0.5 means that the injection distribution ratio KP is set to a value with which the ratio of the port injection amount QP to the total amount of fuel to be burned (the requested injection amount QB) becomes smaller than the ratio of the direct injection amount QD.

If all the sub-conditions (2d) to (2f) are satisfied (S330: YES), the process of the current routine is ended. If at least one of the sub-conditions (2d) to (2f) is not satisfied (S330: NO), the process of this routine in the current cycle is ended after the direct injection learning value update process is executed at step S340.

The learning control section 45 executes the direct injection learning process for learning the direct injection learning value LD[i] by repeatedly executing the direct injection learning value update process. That is, in the direct injection learning control routine, which is repeatedly executed, the direct injection learning process is continued while a state continues in which the process proceeds to the step S340.

Figure 7:
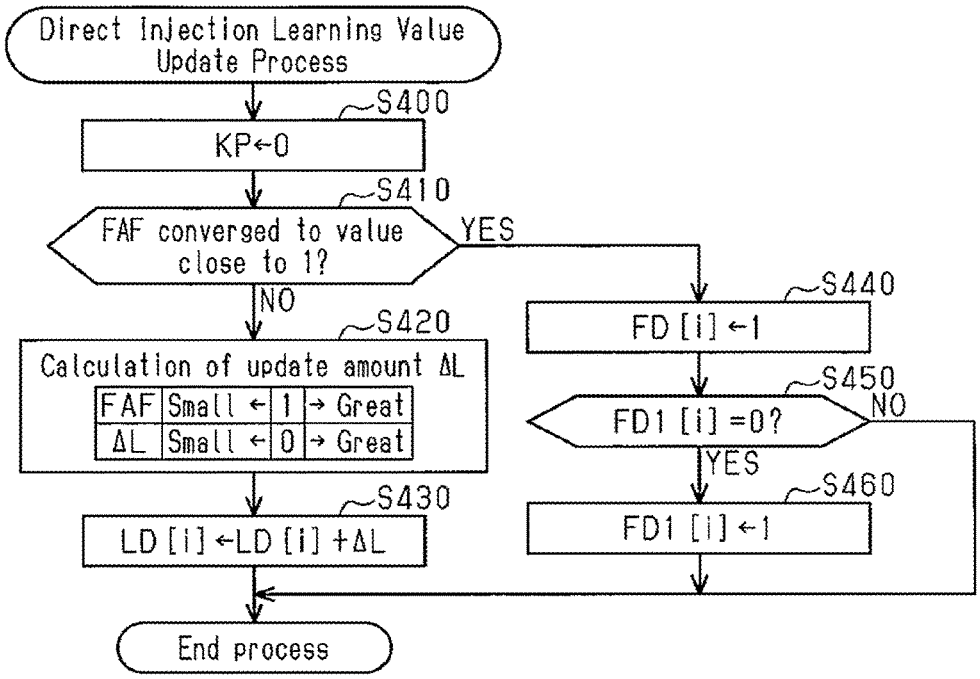
FIG. 7 is a flowchart of a direct injection learning value update process executed by the learning control section of FIG. 2.

FIG. 7 shows a flowchart of the direct injection learning value update process. As shown in FIG. 7, when this process is started, first, at step S400, the value of the injection distribution ratio KP is rewritten to 0 from the value calculated by the distribution ratio calculation section 46 in order to execute fuel injection through the direct injection alone. Subsequently, at step S410, it is determined whether the value of the air-fuel ratio feedback correction factor FAF has converged to a value close to 1.

When it is determined that the value of the air-fuel ratio feedback correction factor FAF has not converged to a value close to 1 (S410: NO), the update amount ΔL for the direct injection learning value LD[i] is calculated at step S420. Subsequently, at step S430, the value of the direct injection learning value LD[i] in the current learning region i is updated to a value obtained by adding the update amount ΔL to the value before updating. The current process is then ended. The determination of convergence of the air-fuel ratio feedback correction factor FAF at step S410 and the calculation of the update amount ΔL at step S420 are executed in the same manner as the determination at step S210 in the port injection update process (FIG. 5) and the calculation at step S220.

In contrast, if it is determined that the value of the air-fuel ratio feedback correction factor FAF has converged to a value close to 1 at step S410 (YES), the value of the direct injection learning completion flag FD[i] in the current learning region i is set to 1 at step S440. The current process is then ended. At this time, if the value of an initial learning completion flag FD1[*i*] for the direct injection in the current learning region i is still 0 (S 450: YES) is still 0, a flag operation is also executed to set the value of the initial learning completion flag FD1[*i*] to 1 at step S460 in addition to the operation of the learning completion flag FD[i] at step S440. The value of the initial learning completion flag FD1[*i*] for the direct injection is also stored in the backup memory in the same manner as the above-described initial learning completion flag FP1[*i*] for the port injection. Specifically, the value of the initial learning completion flag FP1[*i*] is stored in the backup memory and becomes 0, which is the initial value, at the time of the factory shipment or battery-removal memory clearance. Therefore, after the value of the direct injection learning value LD[i] is learned for the first time after the factory shipment or battery-removal memory clearance, the value of the initial learning completion flag FD1[*i*] is maintained at 1 unless the backup memory is cleared due to the removal of the battery.

<Protective Injection Control>

In the port injection learning control as described above, the learning control section 45 executes a protective injection control that permits temporary direct injection. In the port injection learning process, when the direct injection is stopped and only the port injection is executed, the nozzle hole of the direct injection valve 37, which is exposed in the cylinder 16, continues to receive the heat generated by combustion without being cooled by the heat of vaporization of the injected fuel. Then, when the temperature of the nozzle hole becomes higher than a certain level, the fuel remaining in the nozzle hole may incompletely burn to become soot and clog the nozzle hole. In the protective injection control, when the temperature of the nozzle hole of the direct injection valve 37 becomes higher than a specified value during the port injection learning process after the direct injection is stopped, the direct injection is temporarily executed. The learning control section 45 executes the protective injection control by repeatedly executing the process of a protective injection control routine shown in FIG. 8 at specified intervals.

Figure 8:
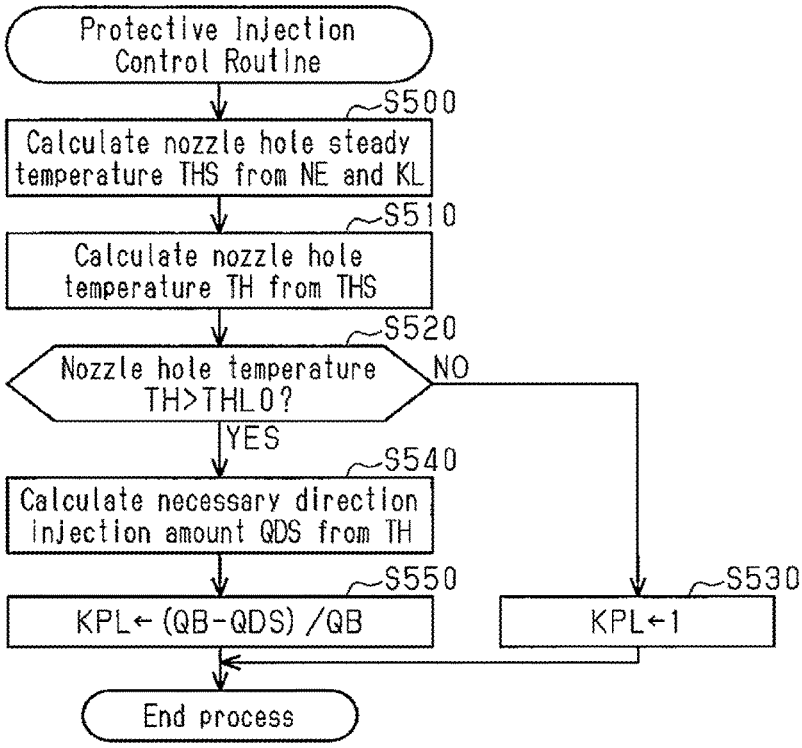
FIG. 8 is a flowchart of a protective injection control routine executed by the learning control section of FIG. 2.

As shown in FIG. 8, when the process of this routine in the present cycle is started, first, at step S500, a nozzle hole steady temperature THS is calculated from the engine speed NE and the cylinder inflow air amount KL. The nozzle hole steady temperature THS is the temperature at the nozzle hole of the direct injection valve 37 (a nozzle hole temperature TH) when it finally converges to a constant value after the engine 10 has continued the steady operation while maintaining the current engine speed NE and cylinder inflow air amount KL. The value of the nozzle hole steady temperature THS is obtained by referring to a map M stored in the electronic control unit 40. The map M stores, for each operating point of the engine 10 defined by the engine speed NE and the cylinder inflow air amount KL, a value of the nozzle hole steady temperature THS at that operating point determined in advance through experiments and simulations.

Figure 9:
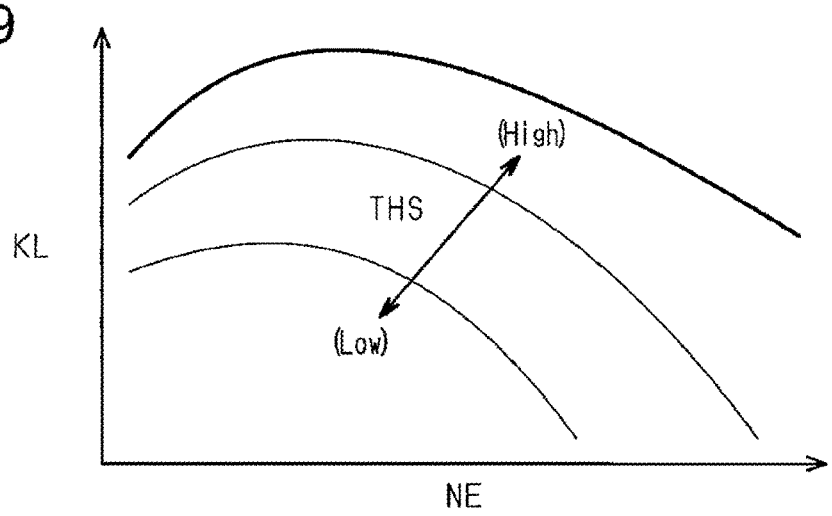
FIG. 9 is a graph showing the relationship of a nozzle hole steady temperature with the engine speed and the cylinder inflow air amount.

FIG. 9 shows the relationship of the nozzle hole steady temperature THS with the engine speed NE and the cylinder inflow air amount KL, which is defined on the map M. As shown in FIG. 9, the map M sets the nozzle hole steady temperature THS such that the higher the engine speed NE and the greater the cylinder inflow air amount KL, the higher the nozzle hole steady temperature THS becomes.

Figure 10:
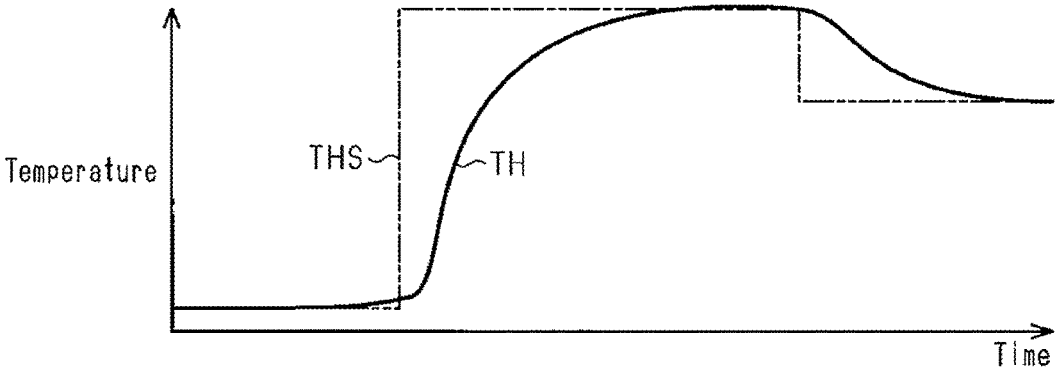
FIG. 10 is a time chart showing the relationship between the nozzle hole steady temperature and the nozzle hole temperature.

When the nozzle hole steady temperature THS is calculated in this manner, the nozzle hole temperature TH is calculated, which is an estimated value of the temperature at the nozzle hole of the direct injection valve 37, from the nozzle hole steady temperature THS at step S510. The nozzle hole temperature TH is calculated from the nozzle hole steady temperature THS using a primary response model. As shown in FIG. 10, the value of the nozzle hole temperature TH calculated in this manner has a value that follows the nozzle hole steady temperature THS with a first order lag element.

Subsequently, at step S520, it is determined whether the nozzle hole temperature TH has exceeded a specified value THL0. The specified value THL0 is set to the maximum value of the nozzle hole temperature TH at which execution of the direct injection reliably prevents the nozzle hole temperature TH from increasing to a level at which residual fuel becomes soot. If the nozzle hole temperature TH at this time is lower than or equal to the specified value THL0 (S520: NO), the process of this routine in the current cycle is ended after the value of the port injection learning distribution ratio KPL is set to 1 at step S530.

Figure 11:
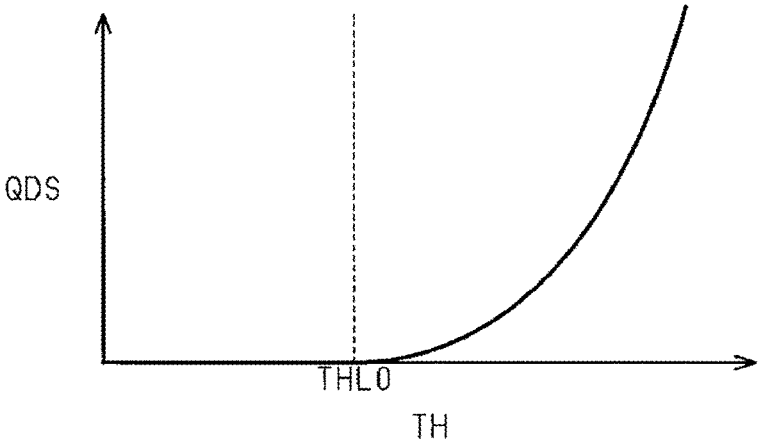
FIG. 11 is a graph showing the relationship between a necessary direct injection amount and the nozzle hole temperature.

In contrast, if the nozzle hole temperature TH is higher than the specified value THL0 (S520: YES), the process proceeds to step S540, at which a necessary direct injection amount QDS is calculated from the nozzle hole temperature TH. The necessary direct injection amount QDS is a fuel injection amount of the direct injection valve 37 necessary for cooling the nozzle hole of the direct injection valve 37 to a temperature lower than the specified value THL0. As shown in FIG. 11, the value of the necessary direct injection amount QDS is calculated to be greater as the nozzle hole temperature TH becomes higher beyond the specified value THL0.

Subsequently, at step S550, the value of the port injection learning distribution ratio KPL is calculated from the necessary injection amount QB and the necessary direct injection amount QDS such that the relationship represented by the following expression is satisfied. This ends the process of this routine in the current cycle. In this case, the injection distribution ratio KP is set to such a value that fuel corresponding to the necessary direct injection amount QDS is injected through the direct injection and fuel corresponding to the value obtained by subtracting the necessary direct injection amount QDS from the necessary injection amount QB is injected through the port injection.

$$KPL=(\text{Necessary Injection Amount } QB-\text{Necessary Direct Injection Amount } QDS)/\text{Necessary Injection Amount } QB$$

<Target Fuel Pressure Setting Process>

Figure 12:
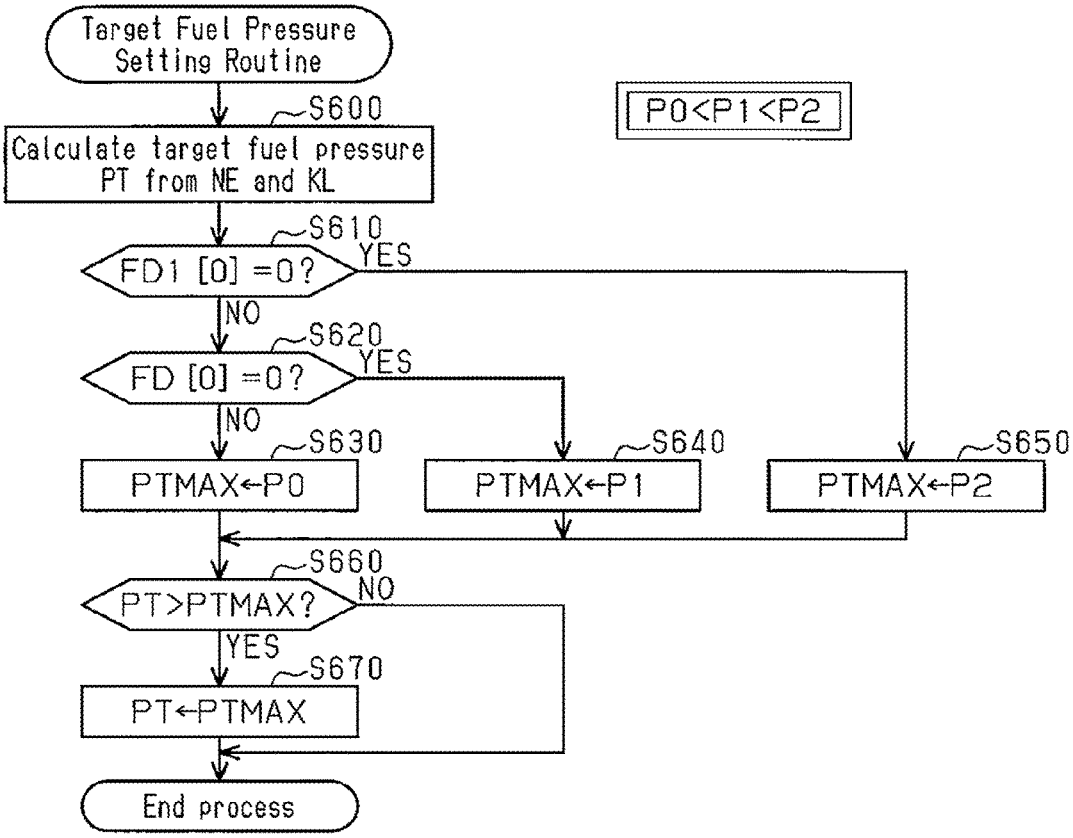
FIG. 12 is a flowchart of a target fuel pressure setting routine executed by the fuel pressure control section of FIG. 2.

Furthermore, in the present embodiment, the fuel pressure control section 47 sets the target fuel pressure PT in the above-described fuel pressure control through the process of a target fuel pressure setting routine shown in FIG. 12. During the operation of the engine 10, the fuel pressure control section 47 repeatedly executes the process of this routine at specified intervals.

As shown in FIG. 12, when the process of this routine is started, first, at step S600, the value of the target fuel pressure PT is calculated from the engine speed NE and the cylinder inflow air amount KL. The calculation of the target fuel pressure PT at this time is executed taking into consideration only the request for the fuel pressure PM according to the operating state of the engine 10. In some cases, due to the insufficient discharge capacity of the high-pressure fuel pump 24, a value that cannot be achieved may be set.

Subsequently, at steps S610 to S650, an upper limit value PTMAX of the target fuel pressure PT is set in accordance with the values of an initial learning completion flag FD1[0] and a learning completion flag FD[0] for the direct injection in the learning region of the identification number 0, which is the region of the smallest value of the intake air amount GA among the above-described five learning regions.

First, when both the value of the initial learning completion flag FD1[0] and the value of the learning completion flag FD[0] are 1 (S610: NO and S620: NO), the upper limit value PTMAX of the target fuel pressure PT is set to a first upper limit value P0 at step S630. The value of the first upper limit value P0 is set to the maximum value of the feasible range of the fuel pressure PM, which is determined by the discharge capacity of the high-pressure fuel pump 24 or the like. In contrast, when the value of the initial learning completion flag FD1[0] is 1 (S610: NO) and the value of the learning completion flag FD[0] of the direct injection learning value LD[0] is 0 (S620: YES), the upper limit value PTMAX of the target fuel pressure PT is set to a second upper limit value P1, which is lower than the first upper limit value P0 at step S640. Further, when the value of the initial learning completion flag FD1[0] is 0 (S 610: YES), the upper limit value PTMAX of the target fuel pressure PT is set to a third upper limit value P2, which is lower than the second upper limit value P1 at step S650.

Thereafter, at step S660, it is determined whether the value of the target fuel pressure PT calculated at step S600 is greater than the upper limit value PTMAX. If the value of the target fuel pressure PT calculated at step S 600 is less than or equal to the upper limit value PTMAX (NO), the process of this routine is ended. In contrast, if the value of the target fuel pressure PT calculated at step S600 is greater than the upper limit value PTMAX (S660: YES), the value of the target fuel pressure PT is rewritten at step S670 to the upper limit value PTMAX from the value calculated at step S600. Thereafter, the process of this routine is ended.

As a result of the process of the target fuel pressure setting routine, the control range of the fuel pressure PM in the fuel pressure control is controlled to fall within the range lower than or equal to the upper limit value PTMAX of the target fuel pressure PT. That is, in the present embodiment, the upper limit value PTMAX of the target fuel pressure PT is the upper limit value of the control range of the fuel pressure PM.

<Operation>

Next, the operation of the fuel injection control device of the engine 10 according to the present embodiment configured as described above will be described.

As described above, in the present embodiment, the direct injection learning process for learning the direct injection learning value LD[i] is executed after changing the injection distribution ratio KP such that fuel injection is executed through the direct injection alone. Likewise, the port injection learning process for learning the port injection learning value LP[i] is executed after changing the injection distribution ratio KP such that fuel injection is executed through the port injection alone except for the case in which the direct injection is executed as a temporary exceptional measure in the protective injection control. Furthermore, in the present embodiment, both the direct injection learning value LD[i] and the port injection learning value LP[i] are learned in all of the five learning regions. In such a case, due to the difference in the variation range of the injection distribution ratio KP necessary for carrying out the learning process, there may be a large difference in the opportunities for execution of the learning process between the two air-fuel ratio learning values. For example, in the operating state in which the value of the injection distribution ratio KP calculated by the distribution ratio calculation section 46 is 0.2, it is only necessary to make a relatively small change to the injection distribution ratio KP, namely from 0.2 to 0, when the direct injection learning process is executed. In contrast, it is necessary to make a relatively great change of the injection distribution ratio KP, namely from 0.2 to 1, when executing the port injection learning process under the same operating state. Therefore, in such an operating state, the opportunities for executing the port injection learning process that requires a great change in the injection distribution ratio KP are limited as compared to the opportunities for executing the direct injection learning process that slightly changes the injection distribution ratio KP.

The learning process for the port injection and the learning process for the direct injection may enter a race condition. The race condition refers to a condition in which, in the current learning region i, the learning of the port injection learning value LP[i] and the learning of the direct injection learning value LD[i] are both incomplete, and the port injection learning condition and the direct injection learning condition are both satisfied.

In such a case, in the present embodiment, the learning process to be executed is selected as described below. In the port injection learning control routine described above (FIG. 4), even though the port injection learning condition is satisfied, the port injection learning process is not executed if the learning of the direct injection learning value LD[i] in the current learning region i has not been completed, the direct injection learning condition is satisfied, and the value of the injection distribution ratio KP calculated by the distribution ratio calculation section 46 is greater than or equal to 0.5. Further, in the direct injection learning control routine described above (FIG. 6), even if the direct injection learning condition is satisfied, the direct injection learning process is not executed in the following case. That is, the direct injection learning process is not executed when the learning of the port injection learning value LP[i] in the current learning region i has not been completed, the port injection learning condition is satisfied, and the value of the injection distribution ratio KP, which is calculated by the distribution ratio calculation section 46, Is less than 0.5.

The learning process to be executed at this time is determined by the value of the injection distribution ratio KP. If the value of the injection distribution ratio KP is greater than or equal to 0.5, the port injection learning process is not executed, and the direct injection learning process is executed. In contrast, if the value of the injection distribution ratio KP is less than 0.5, the port injection learning process is executed, and the direct injection learning process is not executed. That is, when a race condition of the learning processes as described above has occurred, the learning process is executed for one of the port injection and the direct injection, that is, for the injection in which the ratio of the fuel injection amount to the total amount of fuel to be burned in the cylinder 16 (the necessary injection amount QB) is smaller in the value of the injection distribution ratio KP calculated by the distribution ratio calculation section 46. That is, the present embodiment preferentially executes the learning process for one of the port injection and the direct injection in which the variation range of the injection distribution ratio KP necessary for executing the learning process is greater.

Figure 13:
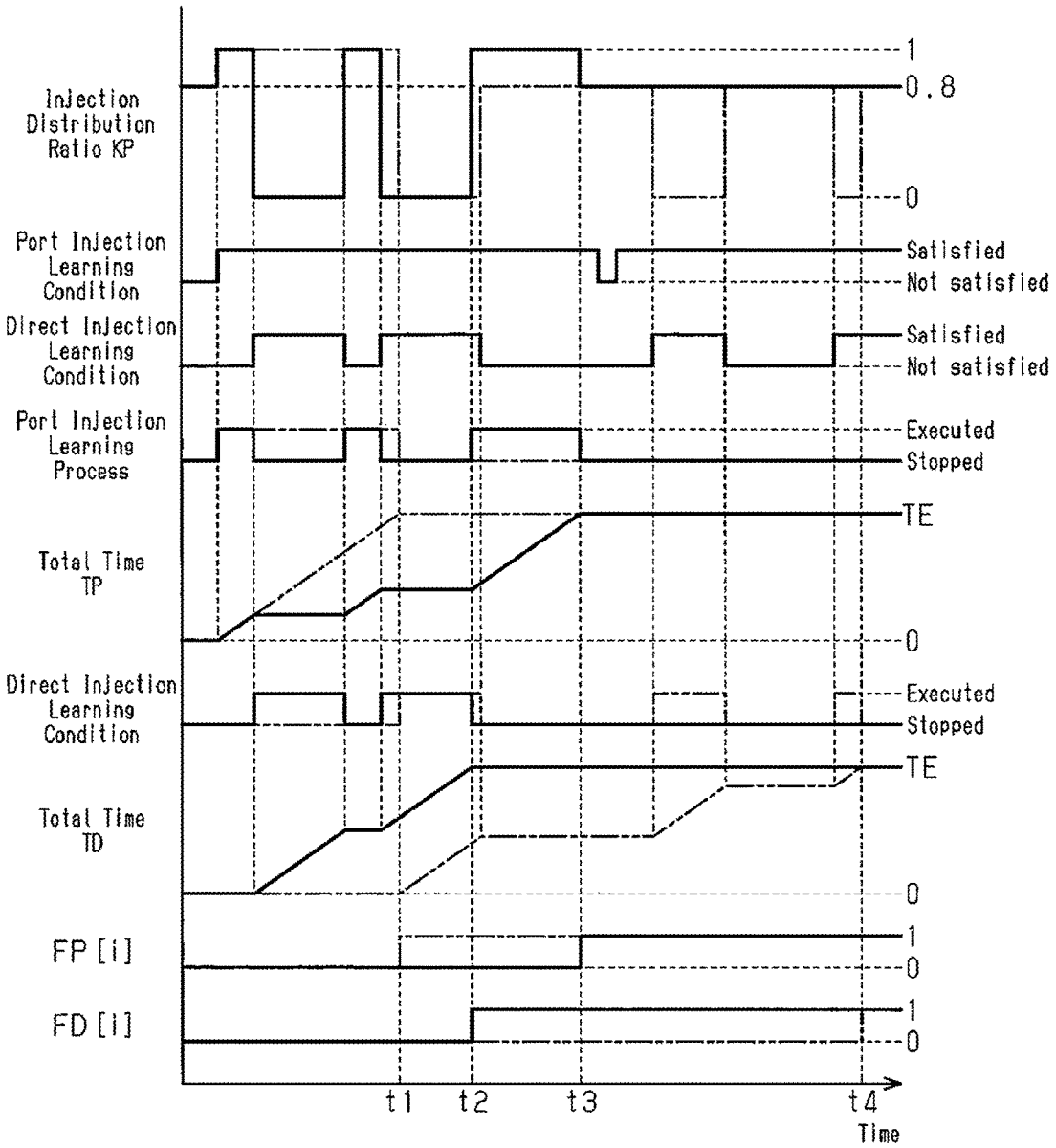
FIG. 13 is a time chart showing an example of a learning process.

FIG. 13 shows an example of the learning process according to the present embodiment. FIG. 13 shows changes in the injection distribution ratio KP, the port injection learning condition, the direct injection learning condition, the execution state of each learning process, the total time TP, TD of each learning process, and the learning completion flags FP[i], FD[i]. The total time TP represents the cumulative total of the time for which the port injection learning process has been executed, and the total time TD represents the cumulative total of the time for which the direct injection learning process has been executed. In this case, the port injection learning process and the direct injection learning process are completed when the total times TP, TD reach TE, respectively. Here, it is assumed that the value of the injection distribution ratio KP calculated by the distribution ratio calculation section 46 remains at 0.8. FIG. 13 also shows a comparative example with long dashed double-short dashed lines, which represent changes in the injection distribution ratio KP, the execution states, the total times TP, TD of each learning process, and the learning completion flags FP[i], FD[i] in the case where the learning process with the smaller change in the injection distribution ratio KP necessary for executing the learning process is preferentially executed.

In the case where the value of the injection distribution ratio KP calculated by the distribution ratio calculation section 46 is 0.8, the change in the injection distribution ratio KP necessary for executing the port injection learning process is smaller than the change in the injection distribution ratio KP necessary for executing the direct injection learning process. Therefore, the port injection learning condition in this case is a condition that is easier to satisfy than the direct injection learning condition.

In the present embodiment, when the port injection learning condition and the direct injection learning condition are both satisfied, the direct injection learning process, in which the change in the injection distribution ratio KP necessary for executing the learning process is greater, is executed preferentially. Therefore, in the period from when the direct injection learning process is completed to a point in time t2 at which the value of the learning completion flag FD[i] is changed from 0 to 1, the direct injection learning process is executed as long as the direct injection learning condition is satisfied even if the port injection learning condition is satisfied.

In contrast, in the case of the comparative example, the port injection learning process is always executed when the port injection learning condition is satisfied until a point in time t1, at which the port injection learning process is completed. Thus, the port injection learning process is completed at an early stage. However, in the comparative example, the direct injection learning process cannot be executed for a limited period to the point in time t1, in which the direct injection learning condition is satisfied. After the point in time t1, the direct injection learning condition is not satisfied frequently. Thus, the completion of the direct injection learning process is significantly delayed. In contrast, in the case of the present embodiment, although the completion of the port injection learning process is delayed as compared to the comparative example, the port injection learning process is also completed in a relatively short time from the completion of the direct injection learning process since the port injection learning condition is satisfied relatively frequently. Therefore, the time when both the learning process for the port injection and the learning process for the direct injection are completed is earlier in the case of the present embodiment (point in time t3) than in the case of the comparative example (point in time t4).

As described above, in the present embodiment, when the execution of the learning process for the port injection learning value LP[i] and the execution of the learning process for the direct injection learning value LD[i] are simultaneously requested, the learning process in which the learning condition is predicted to be hard to satisfy in the current operating state of the engine 10 is preferentially executed.

The execution of the port injection learning process after the direct injection is stopped is restricted by the nozzle hole temperature TH of the direct injection valve 37 as described above. If stopping of the direct injection is an absolute requirement for the port injection learning process, overheating of the nozzle hole of the direct injection valve 37 cannot be avoided completely during the port injection learning process in the operating state in which the cylinder inflow air amount KL is great and a great amount of heat is being generated by combustion. Thus, the port injection learning process cannot be executed. Further, even if the port injection learning process can be started, the nozzle hole temperature TH may rise excessively during the execution, so that the process may be interrupted.

In contrast to this, according to the present embodiment, the above-described protective injection control (FIG. 8) temporarily executes the direct injection for lowering the nozzle hole temperature TH if the nozzle hole temperature TH is increased beyond the specified value THL0 even during the execution of the port injection learning process.

Figure 14:
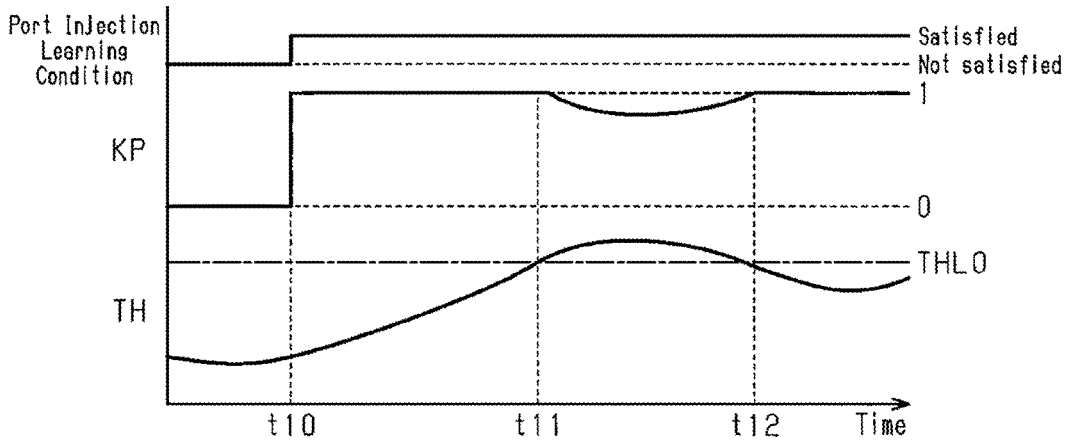
FIG. 14 is a time chart showing an example of a protective injection control.

FIG. 14 shows an example of the protective injection control according to the present embodiment. FIG. 14 illustrates a situation in which the port injection learning process is executed in an operating state in which the cylinder inflow air amount KL is great and the value of the injection distribution ratio KP calculated by the distribution ratio calculation section 46 is 0. That is, in an operating state in which normally the direct injection is executed alone, the port injection learning process is executed after the direct injection is stopped. As described above, in this operating state, since the ratio of the port injection amount to the injection distribution ratio KP calculated by the distribution ratio calculation section 46 is lower than the ratio of the direct injection amount, the port injection learning process is executed as long as the port injection learning condition is satisfied even if the direct injection learning condition is satisfied.

When the port injection learning condition is satisfied at a point in time t10, the injection distribution ratio KP is changed from 0 to 1, and the port injection learning process is started after the direct injection is stopped. At this time, since the cylinder inflow air amount KL is great and the amount of heat generated by the combustion in the cylinder 16 is great, stopping of the direct injection relatively quickly increases the nozzle hole temperature TH. At a point in time t11, the nozzle hole temperature TH reaches the specified value THL0.

When the nozzle hole temperature TH becomes higher than or equal to the specified value THL0, the injection distribution ratio KP is temporarily changed to a value less than 1 so that the direct injection is executed. Thus, the nozzle hole of the direct injection valve 37 is cooled by the heat of vaporization of injected fuel. Then, when the nozzle hole temperature TH drops below the specified value THL0 at a point in time t12, the injection distribution ratio KP is returned to 1.

Execution of the protective injection control prevents the nozzle hole temperature TH of the direct injection valve 37 from being excessively heated even if the port injection learning process is executed in the operation region of the engine 10 in which the cylinder inflow air amount KL is great. This allows the operation region of the engine 10 in which the port injection learning process can be executed to be expanded to the side of increasing the cylinder inflow air amount KL.

In this temporary direct injection by the protective injection control, the value of the injection distribution ratio KP is changed in accordance with the nozzle hole temperature TH such that the higher the nozzle hole temperature TH beyond the specified value THL0, the greater becomes the ratio of the direct injection amount QD to the total amount (the necessary injection amount QB) of the fuel supplied to the cylinder 16. Thus, the injection amount of the temporary direct injection by the protective injection control is kept small as long as the nozzle hole temperature TH does not rise excessively beyond the specified value THL0. This suppresses the influence of the direct injection on the learning result of the port injection learning value LP[i].

In contrast, the operation region of the engine 10 in which the cylinder inflow air amount KL is small is a region in which the injection distribution ratio KP is set such that the ratio of the direct injection amount QD is small and the direct injection learning condition is inherently hard to satisfy. The factors that further reduce the opportunities for the direct injection learning process in such a region are as follows.

When the operation region of the engine 10 abruptly shifts from a region where the cylinder inflow air amount KL is great to a region where the cylinder inflow air amount KL is small, the necessary injection amount QB also abruptly drops. On the other hand, regarding the fuel injection of the direct injection valve 37, there is the minimum injection amount (the minimum injection amount QDMIN) determined by the shortest energization time and the fuel pressure PM.

In the fuel pressure control, when the cylinder inflow air amount KL decreases and the necessary injection amount QB decreases, accordingly, the target fuel pressure PT is lowered so that the requested injection amount QB does not fall below than the minimum injection amount QDMIN of the direct injection valve 37. However, even if the fuel discharge of the high-pressure fuel pump 24 is completely stopped in accordance with the decrease of the target fuel pressure PT, the fuel pressure PM in the high-pressure fuel pipe 26 decreases only by the ratio corresponding to the amount of fuel consumption due to the injection of the direct injection valve 37. Therefore, when the direct inflow air amount KL significantly decreases, the decrease in the fuel pressure PM cannot be made in time. In this case, the requested injection amount QB may fall below the minimum injection amount QDMIN of the direct injection valve 37. In such a state, since the direct injection amount QD cannot be made less than the minimum injection amount QDMIN, the execution of the direct injection inevitably supplies, to the combustion in the cylinder 16, fuel that exceeds the necessary injection amount QB. Therefore, as long as the situation continues in which the minimum injection amount QDMIN of the direct injection valve 37 exceeds the necessary injection amount QB, the direct injection learning processing cannot be executed.

If it is assumed that the decrease rate of the fuel pressure PM is constant, the delay period of the reduction of the fuel pressure PM becomes longer as the decrease margin of the target fuel pressure PT increases. The decrease margin of the target fuel pressure PT is maximized when the target fuel pressure PT is reduced from the upper limit of the set range of the target fuel pressure PT to the lower limit of the set range. Therefore, if the upper limit value PTMAX of the target fuel pressure PT is reduced in advance, the minimum injection quantity QDMIN seldom exceeds the requested injection amount QB.

A situation in which the minimum injection amount QDMIN exceeds the necessary injection amount QB occurs only when the necessary injection amount QB is less than a certain level. That is, there is an upper limit to the necessary injection amount QB that can cause the situation. Such an upper limit value of the necessary injection amount QB is defined as a specified value Y. If the necessary injection amount QB is always greater than the specified value Y, the direct injection learning process will not be unfeasible due to restriction by the minimum injection amount QDMIN.

On the other hand, when the engine speed NE is constant, the cylinder inflow air amount KL and the necessary injection amount QB decrease as the intake air amount GA decreases. Thus, the smaller the intake air amount GA in a learning region, the smaller the minimum value of the necessary injection amount QB in that region becomes. In the present embodiment, among the five learning regions, only the learning region with the identification number 0, which is the region with the smallest intake air amount GA, is a learning region in which the minimum value of the necessary injection amount QB is less than or equal to the specified value Y.

In the present embodiment, when the learning of the direct injection learning value LD[0] in the learning region of the identification number 0 has not been completed, the process of the above-described target fuel pressure setting routine (FIG. 12) sets the upper limit value PTMAX of the target fuel pressure PT to a value (the second upper limit value P1) that is lower than the value at the time of completion of the learning (the first upper limit value P0). Further, in the present embodiment, when the learning of the direct injection learning value LD[0] for the first time after the factory shipment or battery-removal memory clearance, that is, the initial learning of the direct injection learning value LD[0] has not been completed, the upper limit value PTMAX of the target fuel pressure PT is set to a value (the third upper limit value P2), which is lower than the second upper limit value P1.

Figure 15:
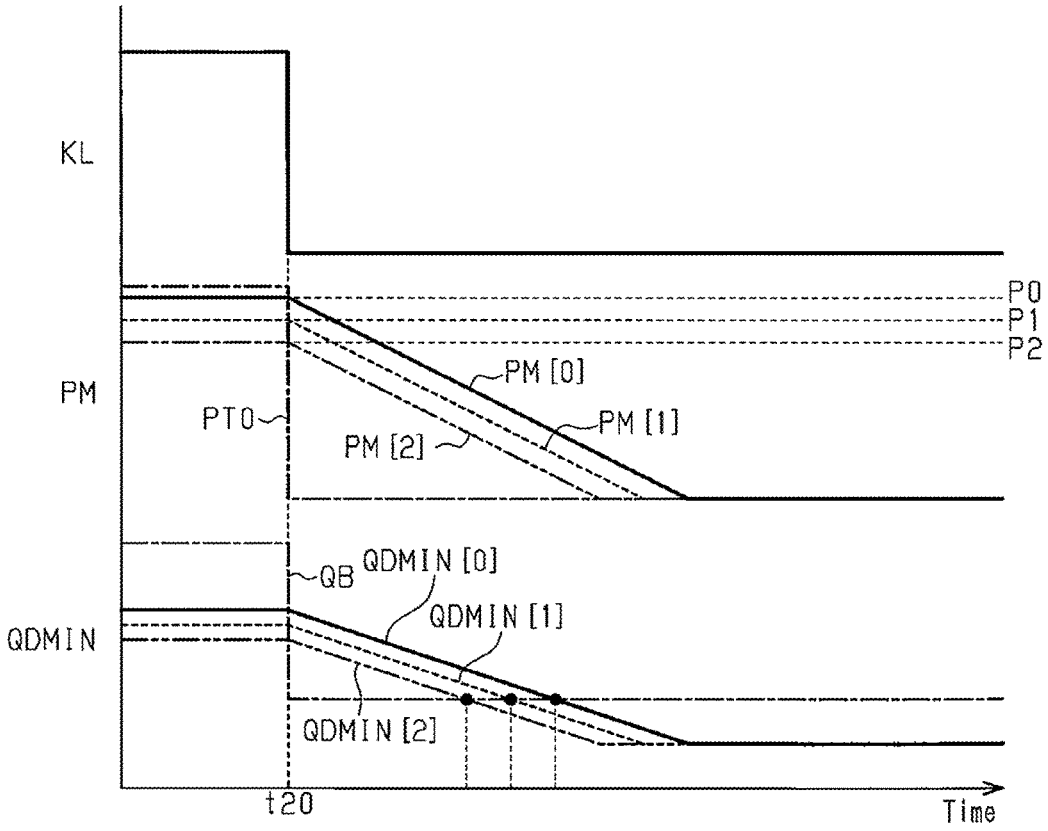
FIG. 15 is a time chart showing changes in a fuel pressure PM, a requested injection amount QB, and a minimum injection amount QDMIN of the direct injection valve when the cylinder inflow air amount KL abruptly drops.

FIG. 15 shows changes in the fuel pressure PM, the requested injection amount QB, and the minimum injection amount QDMIN of the direct injection valve 37 when the cylinder inflow air amount KL decreases to a large extent. PM[0] and QDMIN[0] indicate changes in the fuel pressure PM and the minimum injection amount QDMIN when the upper limit value PTMAX of the target fuel pressure PT is set to the first upper limit value P0. PM[1] and QDMIN[1] indicate changes in the fuel pressure PM and the minimum injection amount QDMIN when the upper limit value PTMAX of the target fuel pressure PT is set to the second upper limit value P1. Furthermore, PM[2] and QDMIN[2] represent changes in the fuel pressure PM and the minimum injection amount QDMIN when the upper limit value PTMAX of the target fuel pressure PT is set to the third upper limit value P2.

In addition, PTO in FIG. 15 represents the value of the target fuel pressure PT (hereinafter, referred to as a base target fuel pressure) at the time of calculation at step S600 in the target fuel pressure setting routine of FIG. 12. The base target fuel pressure PTO is greater than the first upper limit value P0 before a point in time t20, at which the cylinder inflow air amount KL decreases. Therefore, even when the upper limit value PTMAX is set to any one of the first upper limit value P0, the second upper limit value P1, and the third upper limit value P2, the value of the target fuel pressure PT before the point in time t20 is a value to which the upper limit value PTMAX is set.

When the cylinder inflow air amount KL decreases at the point in time t20, the requested injection amount QB also decreases, accordingly. Then, the target fuel pressure PT is reduced such that the minimum injection amount QDMIN of the direct injection valve 37 becomes smaller than the decreased requested injection amount QB. However, even if the target fuel pressure PT is lowered, the fuel pressure PM does not immediately decrease. Therefore, immediately after the point in time t20, the requested injection amount QB is lower than the minimum injection amount QDMIN. At this time, the lower the fuel pressure PM before the target fuel pressure PT is lowered, the earlier becomes the time at which the minimum injection amount QDMIN becomes a value less than or equal to the requested injection amount QB.

Immediately after the point in time t20, if all the requirements for the direct injection learning process other than the requirements for the minimum injection amount QDMIN are satisfied, the direct injection learning process can be started earlier when the upper limit value PTMAX of the target fuel pressure PT is set to the second upper limit value P1 than when the upper limit value PTMAX is set to the first upper limit value P0. Also, the direct injection learning process can be started earlier when the upper limit value PTMAX is set to the third upper limit value P2 than when the upper limit value PTMAX is set to the second upper limit value P1.

As described above, in the present embodiment, when the learning of the direct injection learning value LD[0] has not been completed, the opportunities for executing the learning are increased by lowering the upper limit value PTMAX of the target fuel pressure PT. Further, it is predicted that the initial learning of the direct injection learning value LD[0], which starts updating from the initial value, takes longer time than the second and subsequent times, in which the already learned value is updated. When the initial learning has not been completed, the upper limit value PTMAX of the target fuel pressure PT is further lowered, so that the opportunities for the first learning are further increased. On the other hand, after the learning of the direct injection learning value LD[0] is completed, the upper limit value PTMAX of the target fuel pressure PT is raised, so that high-pressure fuel injection becomes possible.

The above-described embodiment may be modified as follows.

The protective injection control may be omitted if the nozzle hole temperature TH of the direct injection valve 37 only rises to a temperature within the allowable range even when the direct injection is stopped.

In the above-described target fuel pressure setting process, the upper limit value PTMAX is changed in three steps in accordance with three cases: the case when the initial learning has not been completed; the case when the learning of the second and subsequent times has not been completed; and the case when the learning has been completed. However, without taking into consideration whether the incomplete learning is the initial learning, the upper limit value PTMAX may be made different between when the learning has not been completed and when has been completed.

In the above-illustrated embodiment, the upper limit value PTMAX is changed in accordance with whether the learning in the target fuel pressure setting process has been completed. Such change may be made for the direct injection learning value LD[i] in two or more learning regions.

If the minimum injection amount QDMIN never or seldom exceeds the requested injection amount QB, the upper limit value PTMAX does not necessarily need to be changed in accordance whether the learning in the target fuel pressure setting process has been completed.

The learning region may be divided into multiple regions in accordance with parameters indicating the engine operating state other than the intake air amount GA, for example, the engine speed NE or the cylinder inflow air amount KL.

The electronic control unit 40 is not limited to a device that includes a central processing unit and a memory and executes all the above-described processes through software. For example, the electronic control unit 40 may include dedicated hardware (an application specific integrated circuit: ASIC) that executes at least part of the various processes. That is, the electronic control unit 40 may be circuitry including 1) one or more dedicated hardware circuits such as an ASIC, 2) one or more processors (microcomputers) that operate according to a computer program (software), or 3) a combination thereof.

The invention claimed is:

1. A fuel injection control device for an engine, the engine including a port injection valve that injects fuel into an intake port and a direct injection valve that injects fuel into a cylinder, the fuel injection control device comprising:

a distribution ratio calculation section, which is configured to calculate, in accordance with an engine operating state, an injection distribution ratio that is a ratio between a port injection amount, which is an amount of fuel injected from the port injection valve, and a direct injection amount, which is an amount of fuel injected from the direct injection valve;

a learning control section, which is configured to learn a port injection learning value, which is an air-fuel ratio learning value for port injection, and a direct injection learning value, which is an air-fuel ratio learning value for direct injection, separately for each of a plurality of learning regions that are divided according to the engine operating state, wherein the learning control section executes a port injection learning process to learn the port injection learning value in response to satisfaction of a specified port injection learning condition after changing the injection distribution ratio such that a ratio of the port injection amount becomes 100% and a ratio of the direct injection amount becomes 0%, and the learning control section executes a direct injection learning process to learn the direct injection learning value in response to satisfaction of a specified direct injection learning condition after changing the injection distribution ratio such that the ratio of the port injection amount becomes 0% and the ratio of the direct injection amount becomes 100%; and an injection control section, which is configured to distribute a total amount of fuel to be used for combustion in the cylinder to the port injection amount and the direct injection amount in accordance with the injection distribution ratio, correct the distributed port injection amount and direct injection amount using the port injection learning value and the direct injection learning value, respectively, and control fuel injection of the port injection valve and fuel injection of the direct injection valve based on the corrected port injection amount and the corrected direct injection amount, respectively, wherein the learning control section is configured such that, when the port injection learning condition and the direct injection learning condition are both satisfied in a learning region in which neither the learning of the port injection learning value nor the learning of the direct injection learning value has been completed, the learning control section executes the port injection learning process if the ratio of the port injection amount in the injection distribution ratio calculated by the distribution ratio calculation section is less than the ratio of the direct injection amount, and executes the direct injection learning process if the ratio of the direct injection amount in the injection distribution ratio is less than the ratio of the port injection amount.

2. The fuel injection control device for an engine according to claim 1, wherein the learning control section is configured to, when a temperature of a nozzle hole of the direct injection valve exceeds a specified value during execution of the port injection learning process, temporarily change the injection distribution ratio such that fuel injection from the direct injection valve is executed while continuing the port injection learning process.

3. The fuel injection control device for an engine according to claim 2, wherein the learning control section is configured to set the injection distribution ratio at the time of making the temporary change based on the temperature of the nozzle hole of the direct injection valve.

4. The fuel injection control device for an engine according to claim 1, further comprising a fuel pressure control section, which is configured to variably control a fuel supply pressure to the direct injection valve, wherein the fuel pressure control section is configured to, when the learning of the direct injection learning value has not been completed in a learning region in which the total amount of fuel is less than or equal to a specified value, set an upper limit value of a control range of the fuel supply pressure to be lower than that in a state in which the learning has been completed.

5. The fuel injection control device for an engine according to claim 4, wherein the direct injection learning value in a learning region in which the total amount of fuel is less than or equal to the specified value is defined as a learning value X, and the learning control section is configured to, when an initial learning of the learning value X has not been completed, set the upper limit value of the control range of the fuel supply pressure to be even lower than that in a state in which the learning of the learning value X for second and subsequent times has not been completed.

6. A fuel injection control method for an engine, the engine including a port injection valve that injects fuel into an intake port and a direct injection valve that injects fuel into a cylinder, the fuel injection control method comprising:

calculating, in accordance with an engine operating state, an injection distribution ratio that is a ratio between a port injection amount, which is an amount of fuel injected from the port injection valve, and a direct injection amount, which is an amount of fuel injected from the direct injection valve;

learning a port injection learning value, which is an air-fuel ratio learning value for port injection, and a direct injection learning value, which is an air-fuel ratio learning value for direct injection, separately for each of a plurality of learning regions that are divided according to the engine operating state, wherein the learning of the port injection learning value includes executing the learning of the port injection learning value in response to satisfaction of a specified port injection learning condition after changing the injection distribution ratio such that a ratio of the port injection amount becomes 100% and a ratio of the direct injection amount becomes 0%, and the learning of the direct injection learning value includes executing the learning of the direct injection learning value in response to satisfaction of a specified direct injection learning condition after changing the injection distribution ratio such that the ratio of the port injection amount becomes 0% and the ratio of the direct injection amount becomes 100%;

distributing a total amount of fuel to be used for combustion in the cylinder to the port injection amount and the direct injection amount in accordance with the injection distribution ratio;

correcting the distributed port injection amount and direct injection amount using the port injection learning value and the direct injection learning value, respectively;

controlling fuel injection of the port injection valve and fuel injection of the direct injection valve based on the corrected port injection amount and the corrected direct injection amount, respectively; and when the port injection learning condition and the direct injection learning condition are both satisfied in a learning region in which neither the learning of the port injection learning value nor the learning of the direct injection learning value has been completed, executing the learning of the port injection learning value if the ratio of the port injection amount in the calculated injection distribution ratio is less than the ratio of the direct injection amount, and executing the learning of the direct injection learning value if the ratio of the direct injection amount in the injection distribution ratio is less than the ratio of the port injection amount.

7. A fuel injection control device for an engine, the engine including a port injection valve that injects fuel into an intake port and a direct injection valve that injects fuel into a cylinder, wherein the fuel injection control device includes circuitry that is configured to:

calculate, in accordance with an engine operating state, an injection distribution ratio that is a ratio between a port injection amount, which is an amount of fuel injected from the port injection valve, and a direct injection amount, which is an amount of fuel injected from the direct injection valve;

learn a port injection learning value, which is an air-fuel ratio learning value for port injection, and a direct injection learning value, which is an air-fuel ratio learning value for direct injection, separately for each of a plurality of learning regions that are divided according to the engine operating state, wherein the learning of the port injection learning value includes executing the learning of the port injection learning value in response to satisfaction of a specified port injection learning condition after changing the injection distribution ratio such that a ratio of the port injection amount becomes 100% and a ratio of the direct injection amount becomes 0%, and the learning of the direct injection learning value includes executing the learning of the direct injection learning value in response to satisfaction of a specified direct injection learning condition after changing the injection distribution ratio such that the ratio of the port injection amount becomes 0% and the ratio of the direct injection amount becomes 100%;

distribute a total amount of fuel to be used for combustion in the cylinder to the port injection amount and the direct injection amount in accordance with the injection distribution ratio;

correct the distributed port injection amount and direct injection amount using the port injection learning value and the direct injection learning value, respectively; and control fuel injection of the port injection valve and fuel injection of the direct injection valve based on the corrected port injection amount and the corrected direct injection amount, respectively, wherein the circuitry is configured such that, when the port injection learning condition and the direct injection learning condition are both satisfied in a learning region in which neither the learning of the port injection learning value nor the learning of the direct injection learning value has been completed, the circuitry executes the learning of the port injection learning value if the ratio of the port injection amount in the calculated injection distribution ratio is less than the ratio of the direct injection amount, and executes the learning of the direct injection learning value if the ratio of the direct injection amount in the injection distribution ratio is less than the ratio of the port injection amount.

* * * * *